US008094038B2

(12) United States Patent
Nguyen et al.

(10) Patent No.: US 8,094,038 B2
(45) Date of Patent: Jan. 10, 2012

(54) SYSTEMS AND METHODS FOR PROVIDING LOCATION-SPECIFIC INFORMATION

(75) Inventors: Hong Thi Nguyen, Atlanta, GA (US); Michael Sean Denny, Sharpsburg, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 302 days.

(21) Appl. No.: 11/935,469

(22) Filed: Nov. 6, 2007

(65) Prior Publication Data

US 2009/0115621 A1 May 7, 2009

(51) Int. Cl.
*G08B 21/00* (2006.01)

(52) U.S. Cl. ..... 340/686.1; 340/905; 340/534; 340/506; 379/39

(58) Field of Classification Search ..... 340/636.1, 340/905, 534, 506; 379/39
See application file for complete search history.

(56) References Cited

U.S. PATENT DOCUMENTS

| | | | | |
|---|---|---|---|---|
| 2003/0144011 | A1 * | 7/2003 | Richards et al. | 455/456 |
| 2004/0090346 | A1 * | 5/2004 | Simonds et al. | 340/905 |
| 2005/0027449 | A1 * | 2/2005 | Marsh | 701/213 |
| 2005/0046594 | A1 * | 3/2005 | Taylor | 340/905 |
| 2005/0197775 | A1 * | 9/2005 | Smith | 702/3 |
| 2005/0221843 | A1 | 10/2005 | Friedman et al. | |
| 2007/0117573 | A1 | 5/2007 | Kennedy, Jr. et al. | |
| 2008/0048851 | A1 * | 2/2008 | Reyes et al. | 340/506 |

* cited by examiner

*Primary Examiner* — George Bugg
*Assistant Examiner* — Ojiako Nwugo
(74) *Attorney, Agent, or Firm* — Hope Baldauff Hartman, LLC

(57) ABSTRACT

Methods, systems, and computer-readable media are disclosed for providing location-specific information. One such method includes receiving location information corresponding to communication devices. The location information is determined based on characteristics of Internet communications and/or mobile wireless communications of the communication devices. A determination is then made based on the location information that a communication device is located within a certain remote area. Location-specific information that is based on the remote area is then transmitted to the communication device.

22 Claims, 17 Drawing Sheets

SYSTEMS AND METHODS FOR PROVIDING LOCATION-SPECIFIC INFORMATION

TECHNICAL FIELD

This application relates generally to the field of telecommunications. More specifically, this application relates to systems and methods for providing location-specific information.

BACKGROUND

Location-specific information refers to information that corresponds to a certain location. Examples of location-specific information include emergency notification, advertising, maps, and directions. Current technologies provide location-specific information by, for example, broadcasting the location-specific information via television or radio.

One problem with current location-specific information systems is that where a person is not listening to the radio or watching television at the time that the location-specific information is broadcast, such person may not receive the location-specific information. Another problem with current location-specific information systems is that they can be a nuisance to those who are not interested in receiving the location-specific information.

SUMMARY

Systems, methods, and computer program products for providing location-specific information are disclosed. Exemplary embodiments of such methods include receiving location information corresponding to communication devices. The location information is determined based on characteristics of Internet communications and/or mobile wireless communications of the communication devices. A determination is then made based on the location information that a communication device is located within a certain remote area. Location-specific information that is based on the remote area is then transmitted to the communication device.

Exemplary embodiments of a system for providing dynamic location-specific advertising location-specific information include a processor and memory having program instructions. The instructions are executable by the processor and are configured to enable the system to receive location information corresponding to communication devices. The location information is determined based on characteristics of Internet communications and/or mobile wireless communications of the communication devices. The system determines based on the location information that a communication device is located within a certain remote area. The system then transmits location-specific information that is based on the remote area to the communication device.

Exemplary embodiments of a computer-readable storage medium for providing location-specific information includes computer readable instructions configured to enable a computer to receive location information corresponding to communication devices. The location information is determined based on characteristics of Internet communications and/or mobile wireless communications of the communication devices. The computer determines based on the location information that a communication device is located within a certain remote area. The computer then transmits location-specific information that is based on the remote area to the communication device.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

DETAILED DESCRIPTION

The following detailed description is directed to methods, systems, and computer-readable media for providing location-specific information. In the following detailed description, references are made to the accompanying drawings that form a part hereof, and which are shown by way of exemplary embodiments and implementations.

Figure 1A:
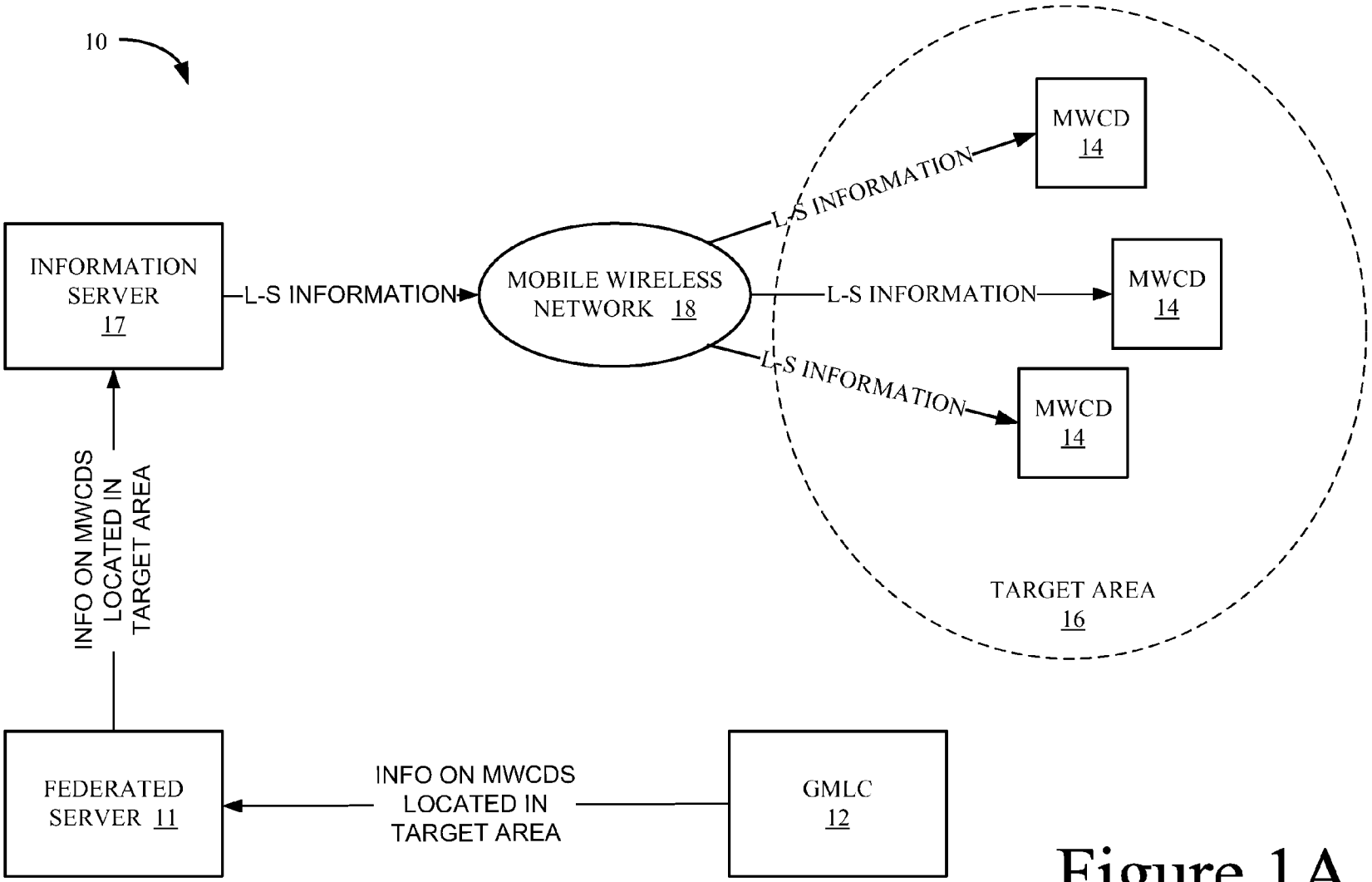
FIGS. 1A and 1B are block diagrams illustrating respective communication systems comprising mobile wireless communication devices (MWCDs), in accordance with exemplary embodiments.

FIG. 1A is a block diagram illustrating a communication system 10, in accordance with exemplary embodiments. The communication system 10 includes a federated server 11, a gateway mobile location center (GMLC) 12, and an information server 17, a mobile wireless network 18, and mobile wireless communication devices (MWCDs) 14. Although the GMLC 12 is shown as being separate from the mobile wireless network 18, the GMLC 12 may in fact be part of the mobile wireless network 18. The MWCDs 14 are configured to communicate using a mobile wireless technology such as, for example, Global System for Mobile Communications (GSM) or Universal Mobile Telecommunications System (UMTS). Note that one or more of the MWCDs 14 may be dual mode user equipment (UE) capable of communicating via both a wireless local area network (LAN) technology (e.g., WiFi) and a mobile wireless technology.

The MWCDs 14 are located within a target area 16. According to exemplary embodiments, the GMLC 12 provides the federated server 11 with location information related to the MWCDs 14. The federated server 11 may receive location information related to the MWCDs 14 from a source other than the GMLC 12. For example, each MWCD 14 may provide the federated server 11 with location information corresponding to the MWCD 14 and/or to other MWCDs 14, as discussed in more detail below.

The federated server 11 provides the location information, a subset thereof, and/or additional information related to the MWCDs 14 to the information server 17. For example, instead of providing information on the exact location of the MWCDs 14, the federated server 11 may provide the information server 17 with information identifying the MWCDs 14 within the target area 16.

According to exemplary embodiments, the information server 17 may transmit advertising content to the MWCDs 14 via the mobile wireless network 18. The advertising content may comprise text data, image data, and/or voice data. The advertising content may be customized based on information about respective users of the MWCDs 14, such as, for example, product preferences, service preferences, demographic information, and/or previous purchases. For example, the information server 17 may send to the MWCD 14 user advertising content related to women's clothing if the MWCD 14 user is determined to be a woman based on information received about the MWCD 14 user. As another example, the federated server 11 may send to the MWCD 14 user advertising content related to a particular sport if the MWCD 14 user is determined to be interested in the particular sport based on, for example, the user's profile.

According to exemplary embodiments, the information server 17 may transmit emergency notification to the MWCDs 14 via the mobile wireless network 18. The information server 17 may receive information about emergencies and corresponding emergency notification content from an emergency dispatch center such as, for example, a public safety answering point (PSAP). The emergency notification may comprise text data, image data, and/or voice data and may correspond to emergency events occurring within the target area 16 or in the vicinity of the target area 16.

The emergency notification may include information on the nature of the emergency (e.g., fire, dangerous person, severe weather, or natural disaster) and a recommended course of action in response to the emergency. For example, an emergency notification may inform a MWCD 14 user of tornadoes in the target area 16 or within the vicinity of the target area and advise the user to move to the basement of the user's home. As another example, an emergency notification may advise the MWCD 14 user of a fire in the building where the user is located and advise the user to leave the building. As yet another example, an emergency notification may advise the MWCD 14 user of gun-shots being heard in the target area 16 or within the vicinity of the target area and advise the user to lock his door.

The emergency notification transmitted by the information server 17 may be customized based on information about respective users of the MWCDs 14, such as, for example, a user's physical condition, more specific location within the target area 16, and whether the user is an emergency response person (e.g., a police officer, a medical care provider or a firefighter). For example, the information server 17 may send to the MWCD 14 user who is a police officer information on where to find a crime suspect in or outside of the target area 16. As another example, the information server 17 may send to the MWCD 14 user who is not part of emergency response personnel instructions on how to safely vacate a structure located within the target area 16. As a further example, the information server 17 may send to the MWCD 14 user who is identified as using a wheelchair directions to an exit path that accommodates wheelchairs. As yet another example, the information server 17 may send to the MWCD 14 user who is a medical care provider information on where to find a person needing medical attention within or outside of the target area 16.

The MWCD 14 user may receive a plurality of emergency notifications that are responsive to the user's movement within the target area 16 and/or to changes to the underlying emergency situation. For example, a first emergency notification may instruct a user on how to safely move from point A to point B within the target area 16. Then, after the user arrives at point B, a subsequent emergency notification may instruct the user on how to safely move from point B to point C. As another example, if a user had previously been notified to move to point C but point C had subsequently become more dangerous, the user may be notified to return to point A. As yet another example, when the underlying emergency situation is determined to have ended or been resolved, MWCD 14 users may be notified of such end or resolution to the emergency situation.

The information about the MWCD 14 users may be provided to the information server 17 by, for example, the federated server 11. The information about the MWCDs 14 users may be based on, for example, information provided by the users when subscribing to the mobile wireless service or to a service provided via the federated server 11 and/or the information server 17.

The target area 16 may be determined based on, for example, an area within a particular distance from a certain object, premises or location. The target area 16 may additionally or alternatively correspond to a certain premises such as, for example, a shopping mall, a theme park, a hospital, a school, a building, or to a combination of premises. According to exemplary embodiments, the target area 16 has a size that is less than or equal to ten square kilometers. According to other exemplary embodiments, the target area 16 has a size that is less than or equal to 1 square kilometer. A determination as to whether the MWCD 14 user is within the target area 16 may be based on a location technology such as, for example, Cell-ID, Enhanced Cell-ID, and time difference of arrival (TDOA).

Cell-ID typically has an accuracy of about 100 meters to 3 kilometers. For Cell-ID, the mobile wireless network 18 uses a cell site and/or a sector within the cell site to estimate a location of an MWCD 14. Enhanced Cell-ID typically has an accuracy of about 75 meters to about 500 meters. For Enhanced Cell-ID, the mobile wireless network 18 uses a cell ID and one or more radio frequency (RF) parameters to estimate a location of a MWCD 14. TDOA typically has an accuracy of about 75 meters to about 500 meters. For TDOA, a mobile wireless network 18 determines a location by computing the time difference of arrival of a signal emitted from the MWCD 14 to three or more receivers.

Note that although only one GMLC 12, one federated server 11, and one location-specific server 17 are shown in FIG. 1, exemplary embodiments include one or more GMLCs 12, one or more federated servers 11, and one or more servers 17. Furthermore, although only three MWCDs 14 are shown in FIG. 1, there may be fewer or additional MWCDs 14 in the target area 16. For example, there may be tens, hundreds, or even thousands of the MWCDs 14 in the target area 16.

Figure 1B:
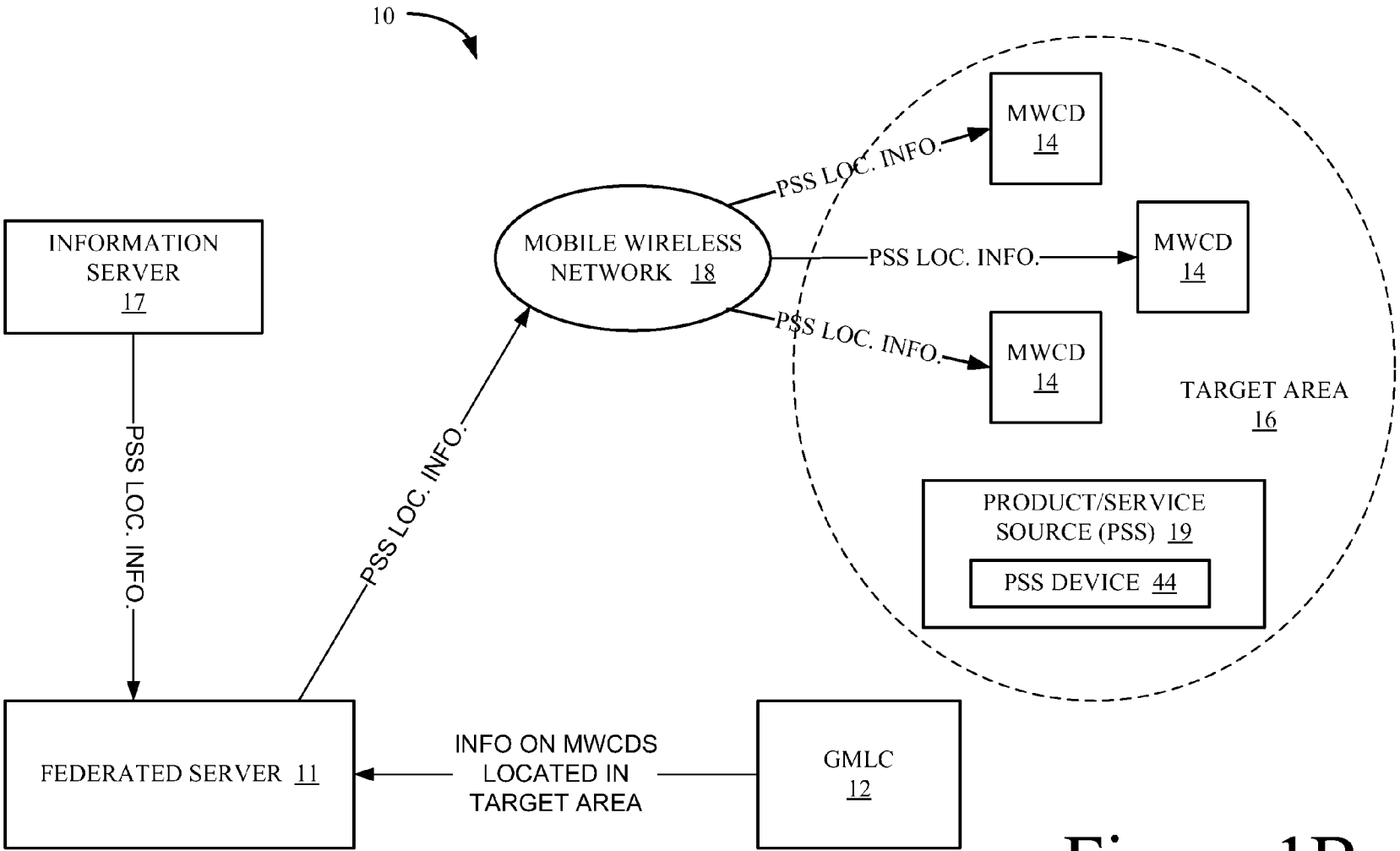

FIG. 1B is a block diagram illustrating a communication system 10, in accordance with exemplary embodiments. The communication system 10 includes the federated server 11, the gateway mobile location center (GMLC) 12, the information server 17, the mobile wireless network 18, a product and/or service source (PSS) 19, and the mobile wireless communication devices (MWCDs) 14.

The PSS 19 comprises a purchase opportunity for a user of the MWCD 14. The PSS 19 may comprise, for example, a store, an office, a vending machine, a booth, a cart, or a vehicle where a product or service is sold or provided. The information server 17 provides the federated server 11 with location information corresponding to the PSS 19. For example, the information server 17 corresponding to a certain company may provide location information corresponding to one or more of the PSSs 19 associated with the company and located in respective target areas, such as the target area 16. Additionally or alternatively, a PSS device 44 may provide the federated server 11 with location information corresponding to the PSS 19. The PSS device 44 may be, for example, a desktop or laptop computer located at a corresponding PSS 19. The location information provided to the federated server 11 may include, for example, longitude/latitude coordinates corresponding to the PSS 19.

According to exemplary embodiments, the federated server 11 transmits PSS 19 location information to the MWCDs 14 via the mobile wireless network 18. The PSS 19 location information may comprise text data, image data, and/or voice data. The PSS 19 location information may for example, include a map, textual directions, and/or voice directions for enabling a user of the MWCD 14 to find the PSS 19.

The PSS 19 location information may be customized or filtered based on information about respective users of the MWCDs 14, such as, for example, product preferences, service preferences, demographic information, and/or previous purchases. For example, the information server 17 may provide an MWCD 14 user with location information corresponding to the PSS 19 that is a women's clothing store if the MWCD 14 user is determined to be a woman. As another example, the information server 17 may provide the MWCD 14 user with location information corresponding to a PSS 19 that is a sporting goods store if the MWCD 14 user is determined to be interested in sports. The information about the MWCDs 14 users may be based on, for example, information provided by the users when subscribing to mobile wireless service or other service provided by one or more companies that operate the federated server 11 and/or the information server 17. The information about the MWCD 14 users may be provided to the federated server 11 by, for example, a back office server (BOS).

The target area 16 may be determined based on, for example, an area within a particular distance from a certain object, premises or location. For example, the target area 16 may be determined based on a predetermined distance from the PSS device 44, the PSS 19, or MWCD 14. There may be several target areas having different sizes and locations. When the MWCD 14 is within a first target area, such as the target area 16, then the MWCD 14 is provided with location information corresponding to one or more of the PSSs 19 located in the first target area 16, according to exemplary embodiments. When the MWCD 14 moves into a second target area, then the MWCD 14 is provided with location information corresponding to one or more of the PSSs 19 located in the second target area 16. Furthermore, when a mobile PSS 19, such as, for example, an ice cream truck or a street vendor, moves into the target area 16 where the MWCD 14 is located, the MWCD 14 may be provided with location information corresponding to the mobile PSS 19. The PSS 19 location information may be provided to the MWCD 14 responsive to a request from the MWCD 14, responsive to a current time, and/or responsive to determining that the MWCD 14 has entered the target area 16.

According to exemplary embodiments, the MWCD 14 user is provided with a dynamic map that shows locations of the PSSs 19 within the target area 16 relative to the user. The dynamic map may be updated to show other PSSs 19 as the MWCD 14 changes locations within the target area 16 and moves into other target areas. For example, the dynamic map is updated to show the PSSs 19 located within a certain distance of the MWCD 14. The MWCD 14 user may additionally or alternatively be provided with a dynamic list of the PSSs 19 that are within a certain distance of the MWCD 14. The user of the MWCD 14 may select a list of the PSSs 19 in order to view corresponding location information.

Figure 2A:
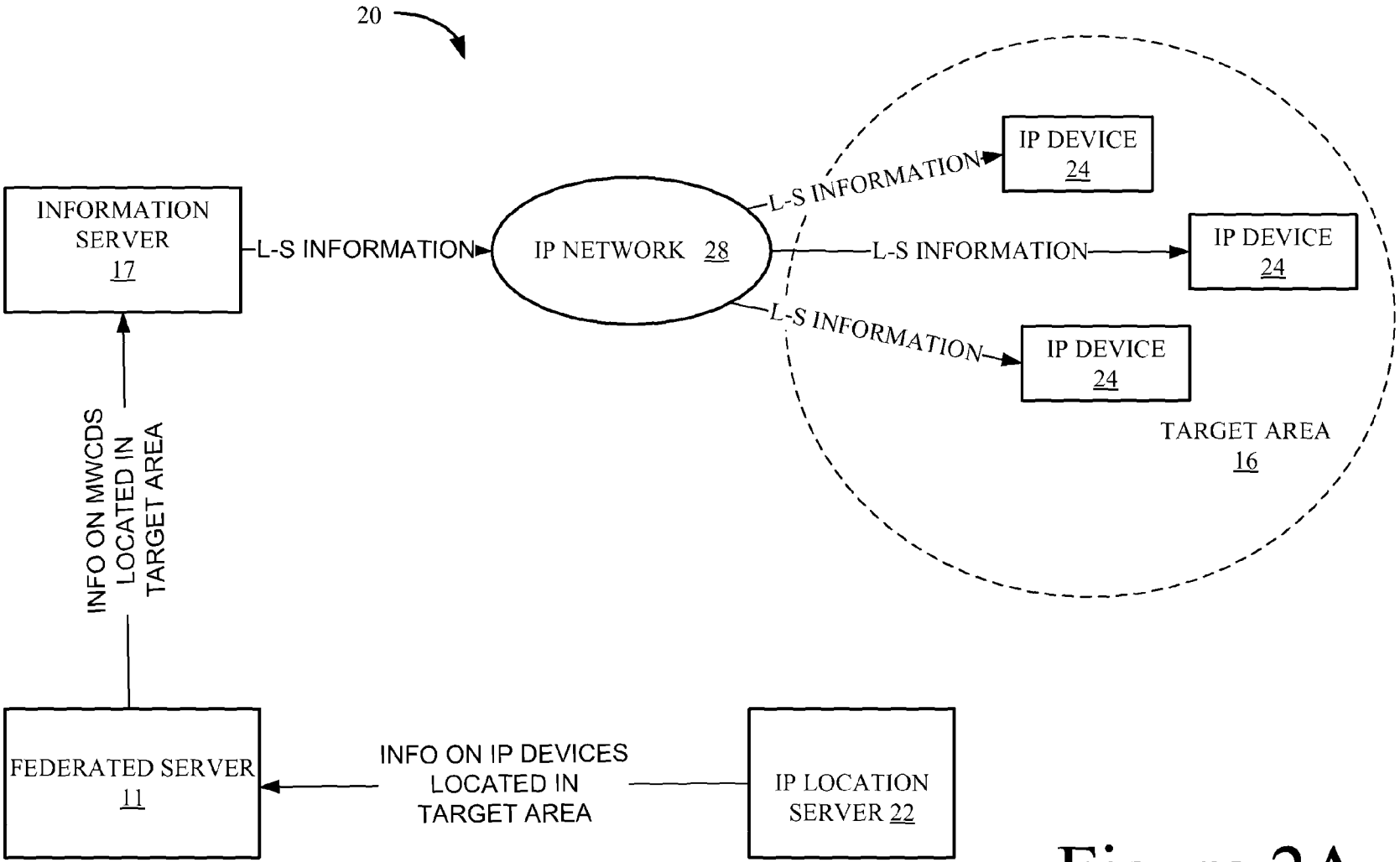
FIGS. 2A and 2B are block diagrams illustrating respective communication systems comprising internet protocol (IP) devices, in accordance with exemplary embodiments.

FIG. 2A is a block diagram illustrating a communication system 20, in accordance with exemplary embodiments. The communication system 20 includes the federated server 11, an Internet protocol (IP) location server 22, the information server 17, an IP network 28 and IP devices 24. According to exemplary embodiments, each of the IP devices 24 is a device that is capable of communicating using IP. Examples of the IP devices 24 include computers, personal digital assistants (PDAs), and IP enabled mobile telephones. The IP devices 24 are located within the target area 16.

According to exemplary embodiments, the IP location server 22 provides the federated server 11 with location information related to the IP devices 24. The federated server 11 may receive location information related to the IP devices 24 from a source other than the IP location server 22. For example, each of the IP devices 24 may provide the federated server 11 with location information corresponding to the IP device 24 and/or to other IP devices 24, as discussed in more detail below.

The federated server 11 provides the location information, a subset thereof, and/or additional information related to the IP devices 24 to the information server 17. For example, instead of providing information on the specific location of the IP devices 24, the federated server 11 may provide the information server 17 with information identifying the IP devices 24 within the target area 16. A determination as to whether the IP device 24 user is within the target area 16 may be based, for example, on the IP address being used by the IP device 24.

The information server 17 may transmit advertising content to the IP devices 24 via the IP network 28. The IP network 28 may comprise, for example, the Internet. The advertising content may be customized based on information about respective users of the IP devices 24, such as, for example, product preferences, service preferences, demographic information, and/or previous purchases.

The information server 17 may alternatively transmit emergency notification to the IP devices 24 via the IP network 28. The emergency notification may be customized based on information about respective users of the IP devices 24, such as, for example, a user's physical condition, more specific location within the target area 16, and whether the user is an emergency response person (e.g., law enforcement person, medical care provider, or firefighter).

The information about the IP device 24 users may be provided to the information server 17 by, for example, the federated server 11. The information about the IP devices 24 users may be based on, for example, information provided by the users when subscribing to an Internet access service or to a service provided via the federated server 11 and/or the information server 17.

Note that although only one IP location server 22, one federated server 11, and one information server 17 are shown in FIG. 2, exemplary embodiments include one or more IP location servers 22, one or more federated servers 11, and one or more information servers 17. Furthermore, although only three IP devices 24 are shown in FIG. 2, there may be fewer or additional IP devices 24 in the target area 16. For example, there may be tens, hundreds, or even thousands of the IP devices 24 in the target area 16.

Figure 2B:
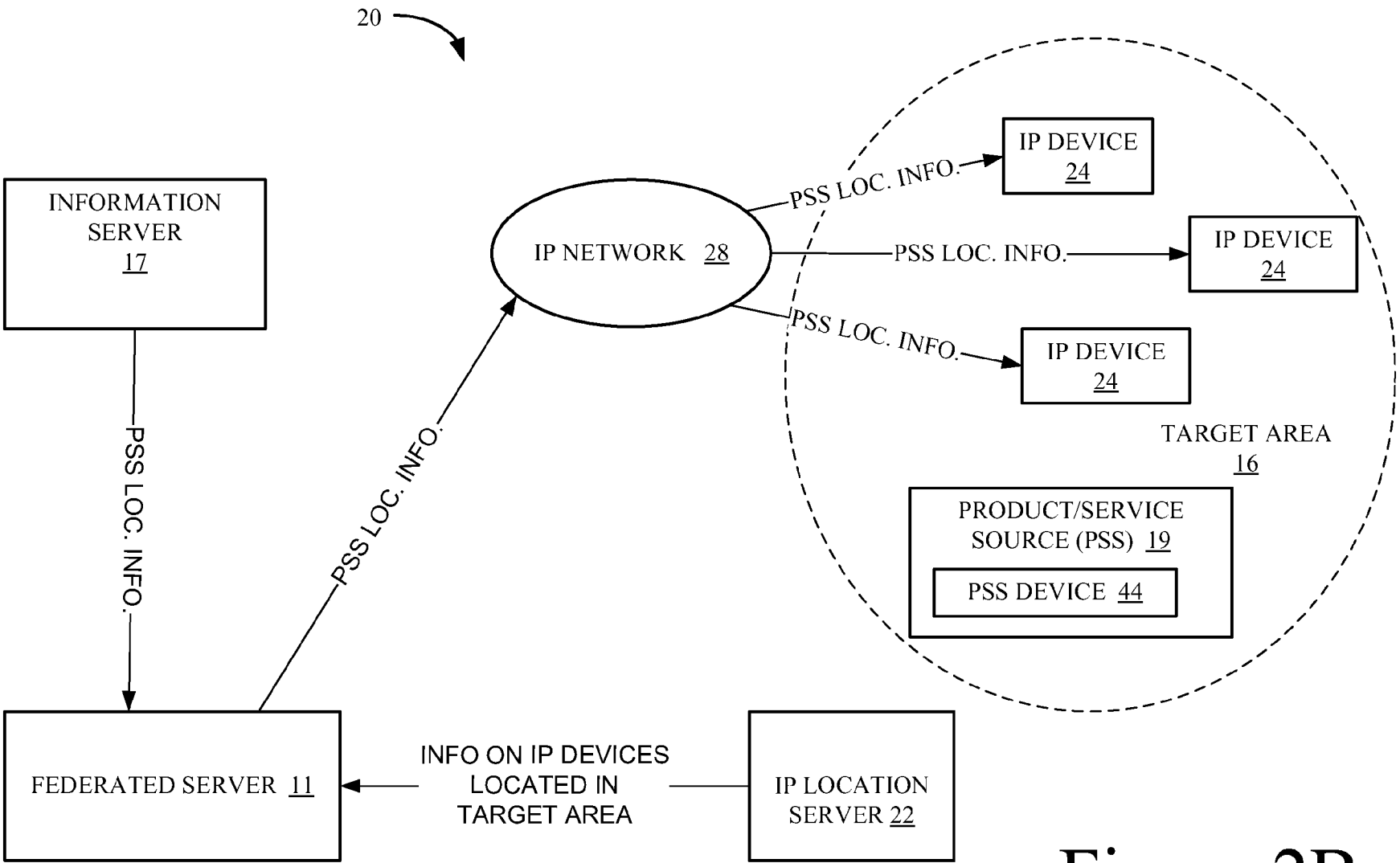

FIG. 2B is a block diagram illustrating a communication system 20, in accordance with exemplary embodiments. The communication system 20 includes the federated server 11, an Internet protocol (IP) location server 22, the information server 17, the PSS 19, an IP network 28 and IP devices 24. The federated server 11 transmits PSS 19 location information to the IP devices 24 via the IP network 28. The PSS 19 location information may comprise text data, image data, and/or voice data. The PSS 19 location information may for example, include a map, textual directions, and/or voice directions for enabling users of the devices 14 and 24 to find the PSS 19. The IP network 28 may comprise, for example, the Internet. The PSS 19 location information may be customized or filtered based on information about respective users of the IP devices 24, such as, for example, product preferences, service preferences, demographic information, and/or previous purchases. The information about the IP device 24 users may be based on, for example, information provided by the users when subscribing to an Internet access service or other service provided by one or more companies that operate the federated server 11 and/or the information server 17.

Figure 3A:
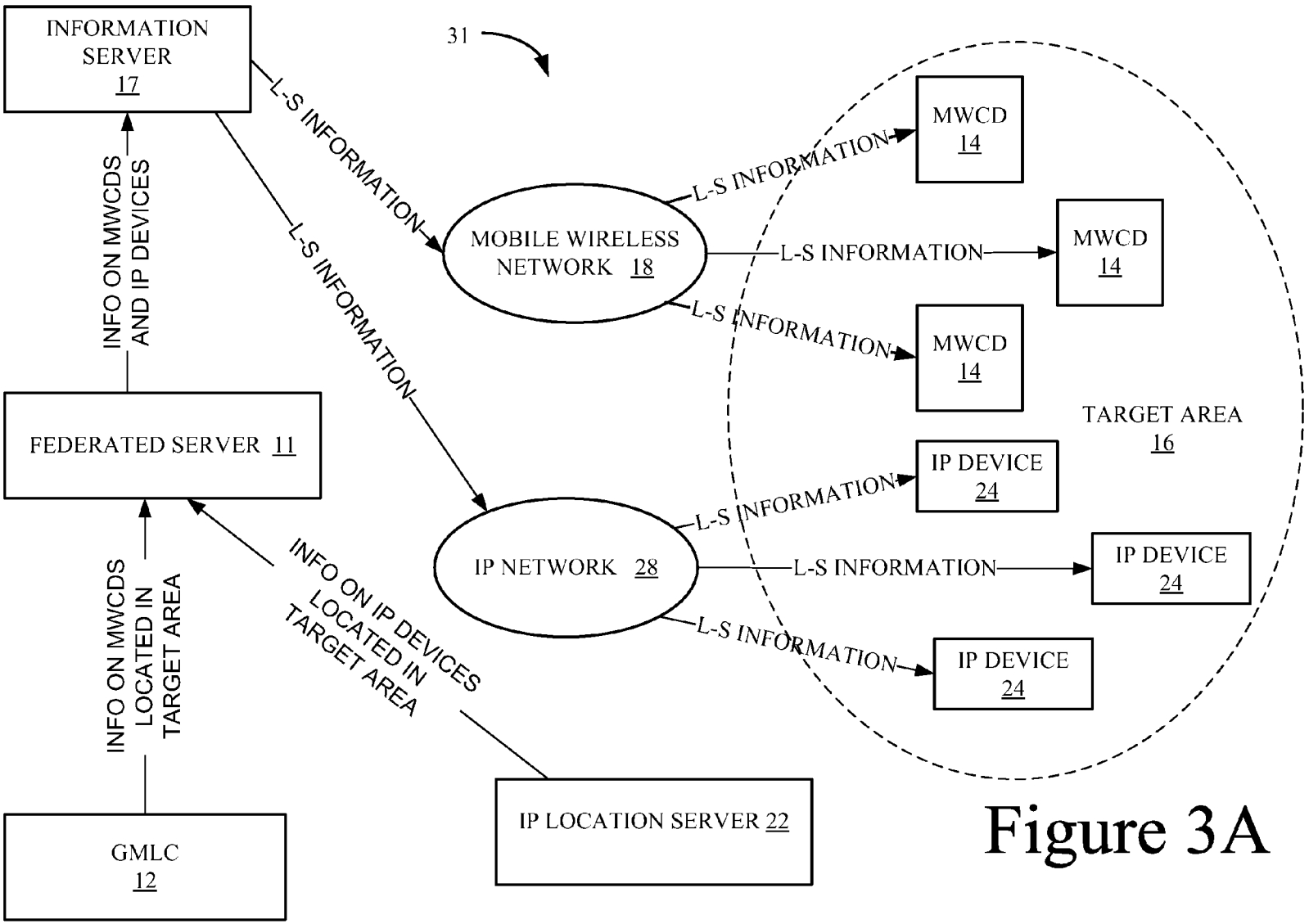
FIGS. 3A-3C and 4-5 block diagrams illustrating respective communication systems comprising MWCDs and IP devices, in accordance with exemplary embodiments.

FIG. 3A is a block diagram illustrating a communication system 31, in accordance with exemplary embodiments. The communication system 31 includes the federated server 11, the GMLC 12, the IP location server 22, the information server 17, the mobile wireless network 18, the IP network 28, the MWCDs 14, and the IP devices 24. The MWCDs 14 and the IP devices 24 are located within the target area 16.

According to exemplary embodiments, the federated server 11 receives location information corresponding to the MWCDs 14 and/or the IP devices 24 from the IP location server 22 and/or the GMLC 12 and stores the location information in a device location information database. The location information received by the federated server may include, for example, respective latitude and longitude coordinates. In addition to the location information associated with the MWCDs 14 and/or IP devices 24, the federated server 11 may receive contact information and user information corresponding to the MWCDs 14 and/or IP devices 24. Examples of respective contact information received by the federated server include telephone number, IP address, and e-mail address. Respective user information may include, for example, name, age, occupation, product preferences, service preferences, and/or medical condition. Note that respective location information may alternatively or additionally be received from the MWCDs 14 and/or IP devices 24.

The federated server 11 may process the received information to determine whether the MWCDs 14 and/or IP devices 24 are within a particular area, such as the target area 16. For example, the federated server 11 may receive location information corresponding to the MWCDs 14 and/or IP devices 24 having various random locations. Each of the MWCDs 14 and/or IP devices 24 may transmit corresponding location information to the federated server 11 responsive to, for example, a request from the federated server 11 for the location information and/or responsive to a location of the MWCD 14 or the IP device 24. The request from the federated server 11 may be broadcast to the devices 14 and/or 24 or may be transmitted to the devices 14 and/or 24 using devices' contact information. The contact information for each device 14, 24 may, for example, be provided to the entity or entities operating the federated server 11 or the information server 17 when a user of the devices 14 and/or 24 signs up for a service provided by such entity or entities. Each of the MWCDs 14 and/or IP devices 24 may be configured to transmit location information when a location of the device 14 or 24 meets one or more criteria. For example, the device 14 or 24 may transmit location information to the federated server 11 when the device 14 or 24 moves into or out of the target area 16. A device 14 or 24 may have a software application that includes information regarding the scope of various target areas 16. Each device 14 or 24 may compare location coordinates for such device 14 or 24 with location coordinates of various target areas 16 to determine in which target area the device 14 or 24 is located.

Alternatively or additionally, the MWCD 14 and/or IP device 24 may provide the location information to the federated server 11 at predetermined times or time intervals. Furthermore, the device 14 or 24 may transmit location information to the federated server 11 responsive to the device being turned on and/or communicating via a respective network, such as the network 18 or 28.

The federated server 11 may then process the location information received to identify a subset of the MWCDs 14 and/or IP devices 24 located in a particular area, such as the target area 16. The federated server 11 may determine that a particular device 14 or 24 is in a particular target area, such as the target area 16 by, for example, determining that the longitude and latitude coordinates of the device 14 or 24 correspond to coordinates within the target area 16. The federated server 11 may then provide the location information and contact information corresponding to the subset of the MWCDs 14 and/or IP devices 24 to the information server 17. The federated server 11 may also provide the information server 17 with information regarding the users of the MWCDs 14 and/or IP devices 24.

The federated server 11 may also be configured to determine if location information corresponding to a device, such as the MWCD 14, is still valid. The determination may be based on a time since the location information has been received, on a type of device to which the location information corresponds, and/or on a location history of the device. For example, location information corresponding to a desktop computer may be presumed to be valid for a longer time period than the location information corresponding to a cellular telephone. Location information corresponding to the MWCD 14 or IP device 24 may be updated by the federated server 11 when more recent location information corresponding to the MWCD 14 or IP device 24 is received by the federated server 11 from the GMLC 12 or the device 14 or 24. As discussed above, location information may be provided to the federated server 11 responsive to a request for such information from the federated server 11 and/or responsive to other factors or circumstances such as a location of the device 14 or 24, the current time, and/or the time that has elapsed since location information had previously been provided to the federated server 11.

According to exemplary embodiments, the information server 17 transmits respective location-specific information to the MWCDs 14 via the mobile wireless network 18 and/or to the IP devices 24 via the IP network 28 based on the location information and contact information corresponding to the subset of the MWCDs 14 and/or IP devices 24 determined to be within the target area 16. According to exemplary embodiments, some of the IP devices 24 and/or MWCDs 14 may be configured to communicate via more than one communication technology. For example, the MWCD 14 may be a dual mode user equipment (UE) capable of communicating via a mobile wireless technology and via a local area network (LAN) technology. Furthermore, a single device within the target area 16 may be classifiable as a MWCD 14 and as an IP device 24. Therefore, the information server 17 may transmit location-specific information to some of the MWCDs 14 via the IP network 28 and/or may transmit location-specific information to some of the IP devices 24 via the mobile wireless network 18, depending on a desired implementation.

According to exemplary embodiments, the federated server 11 may transmit respective advertising content to the MWCDs 14 via the mobile wireless network 18 and/or to the IP devices 24 via the IP network 28. As discussed above, the advertising content may be customized based on information about respective users of the MWCDs 14 and the IP devices 24, such as, for example, product preferences, service preferences, demographic information, and previous purchases.

Furthermore, the federated server 11 may transmit emergency notification to the MWCDs 14 and/or the IP devices 24. The emergency notification may be customized based on information about respective users of the devices 14 and/or 24, such as, for example, a user's physical condition, more specific location within the target area 16, and whether the user is an emergency response person. The information about users of the MWCDs 14 and the IP devices 24 may be provided to the information server 17 by the federated server 11.

Figure 3B:
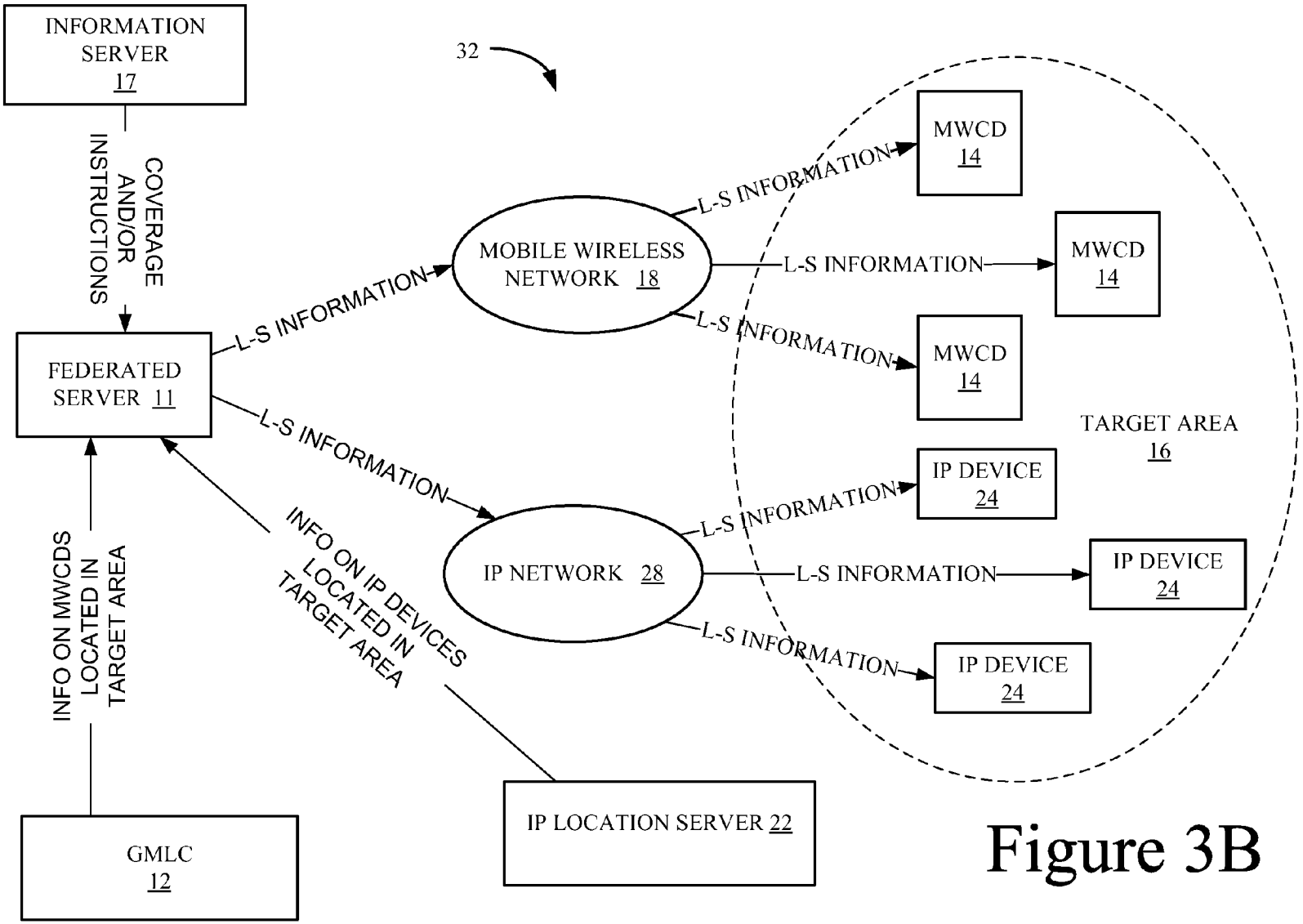

FIG. 3B is a block diagram illustrating a communication system 32, in accordance with exemplary embodiments. The communication system 32 includes the federated server 11, the GMLC 12, the IP location server 22, the mobile wireless network 18, the IP network 28, the MWCDs 14, and the IP devices 24. The MWCDs 14 and the IP devices 24 are located within the target area 16.

According to exemplary embodiments, the federated server 11 receives location and/or contact information corresponding to the MWCDs 14 and/or IP devices 24 from the IP location server 22 and/or the GMLC 12 and stores the location information in a device location information database. Note that respective location information may alternatively or additionally be received from the MWCDs 14 and/or IP devices 24.

The federated server 11 may process the received information to determine whether the MWCDs 14 and/or IP devices 24 are within a particular area, such as the target area 16. For example, the federated server 11 may receive location information corresponding to the MWCDs 14 and/or IP devices 24 having various random locations. The federated server 11 may then process the location information received to identify a subset of the MWCDs 14 and/or IP devices 24 located in a particular area, such as the target area 16.

According to exemplary embodiments, the federated server 11 transmits respective location-specific information to the MWCDs 14 via the mobile wireless network 18 and/or to the IP devices 24 via the IP network 28 based on the location information and contact information corresponding to the subset of the MWCDs 14 and/or IP devices 24 determined to be within the target area 16. As discussed above, advertising content provided by the federated server 11 may be customized based on information about respective users of the MWCDs 14 and the IP devices 24, such as, for example, product preferences, service preferences, demographic information, and previous purchases. Furthermore, emergency notification provided by the federated server 11 may be customized based on, for example, a user's physical condition, more specific location within the target area 16, and whether the user is an emergency response person.

Figure 3C:
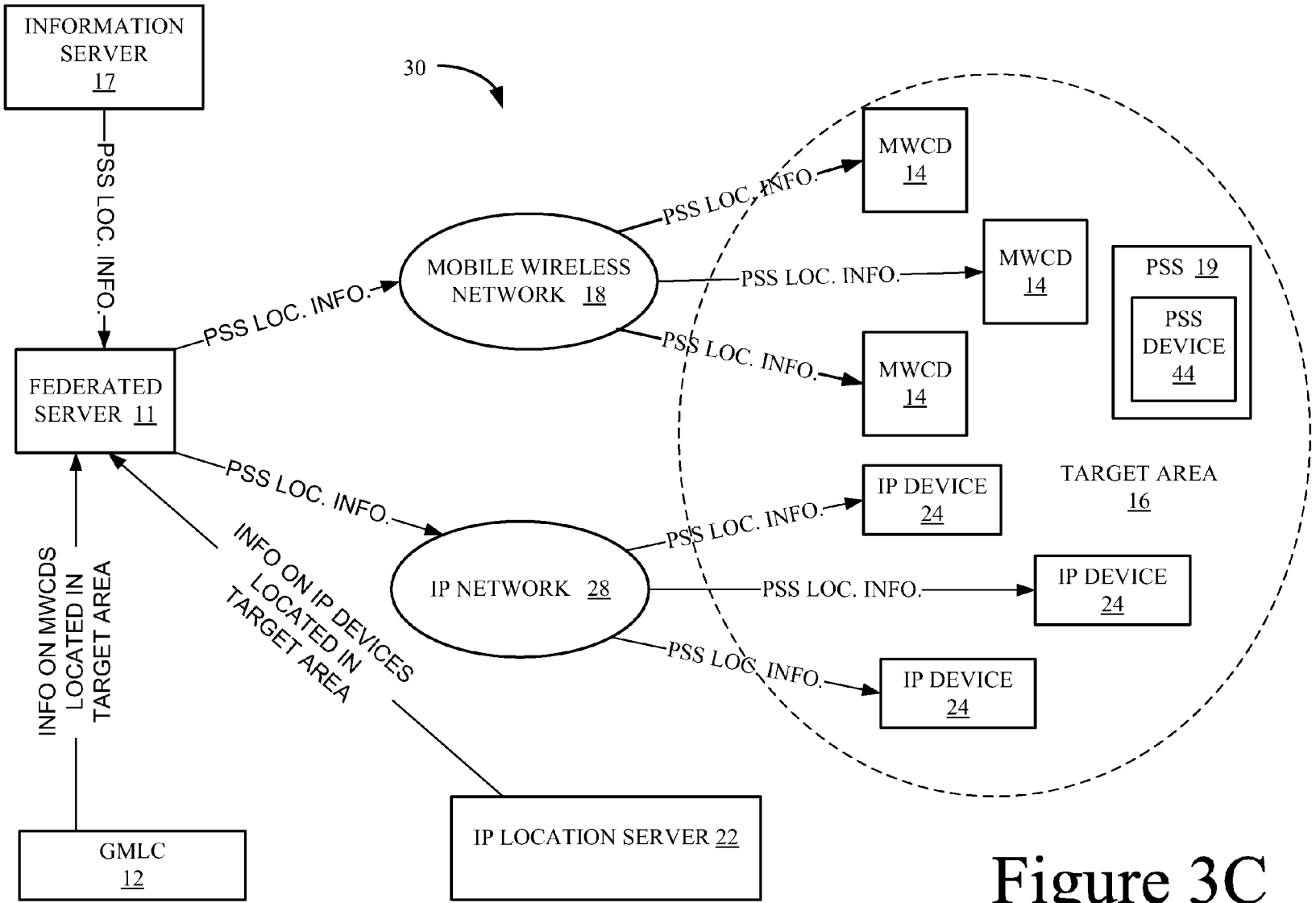

FIG. 3C is a block diagram illustrating a communication system 30, in accordance with exemplary embodiments. The communication system 30 includes the federated server 11, the GMLC 12, the IP location server 22, the information server 17, the PSS 19, the mobile wireless network 18, the IP network 28, the MWCDs 14, and the IP devices 24. The MWCDs 14, the PSS 19, the PSS device 44, and the IP devices 24 are located within the target area 16.

According to exemplary embodiments, the federated server 11 receives location information corresponding to the MWCDs 14 and/or the IP devices 24 from the IP location server 22 and/or the GMLC 12 and stores the location information in a device location information database. The location information received by the federated server may include, for example, respective latitude and longitude coordinates. In addition to the location information associated with the MWCDs 14 and/or IP devices 24, the federated server 11 may receive contact information and user information corresponding to the MWCDs 14 and/or IP devices 24. Examples of respective contact information received by the federated server include telephone number, IP address, and e-mail address. Respective user information may include, for example, name, age, occupation, and/or product and service preferences. Note that respective location information may alternatively or additionally be received from the MWCDs 14 and/or IP devices 24.

The federated server 11 may provide the information server 17 with information identifying the scope of the target area 16 so that the information server 17 can identify the PSSs 19 located in the target area 16. After the information server 17 identifies PSSs 19 located in the target area 16, the information server 17 provides the federated server 11 with location information corresponding to such PSSs 19. Alternatively, the information server 17 provides the federated server 11 with location information corresponding to various PSSs 19 located in various target areas 16 and the federated server 11 then determines which target area 16 corresponds to each PSS 19. The information server 17 may provide the PSS 19 location information to the federated server 11 responsive to, for example, a request by the federated server 11 for such information. For example, the information server 17 corresponding to a certain company may provide location information corresponding to one or more of the company's PSSs 19 located in the target areas 16. Additionally or alternatively, a computing and/or communication device, such as the PSS device 44, located at the PSS 19 may provide the federated server 11 with location information corresponding to the PSS 19.

The federated server 11 transmits the PSS 19 location information to the devices 14 and 24 located in the corresponding target area 16 via respective networks 18 and 28. As discussed above, the PSS 19 location information may be customized or filtered based on information about respective users of the MWCDs 14 and the IP devices 24, such as, for example, product preferences, service preferences, demographic information, and previous purchases. The PSS 19 location information may comprise text data, image data, and/or voice data. The PSS 19 location information may for example, include a map, textual directions, and/or voice directions for enabling users of the devices 14 and 24 to find the PSS 19.

Figure 4:
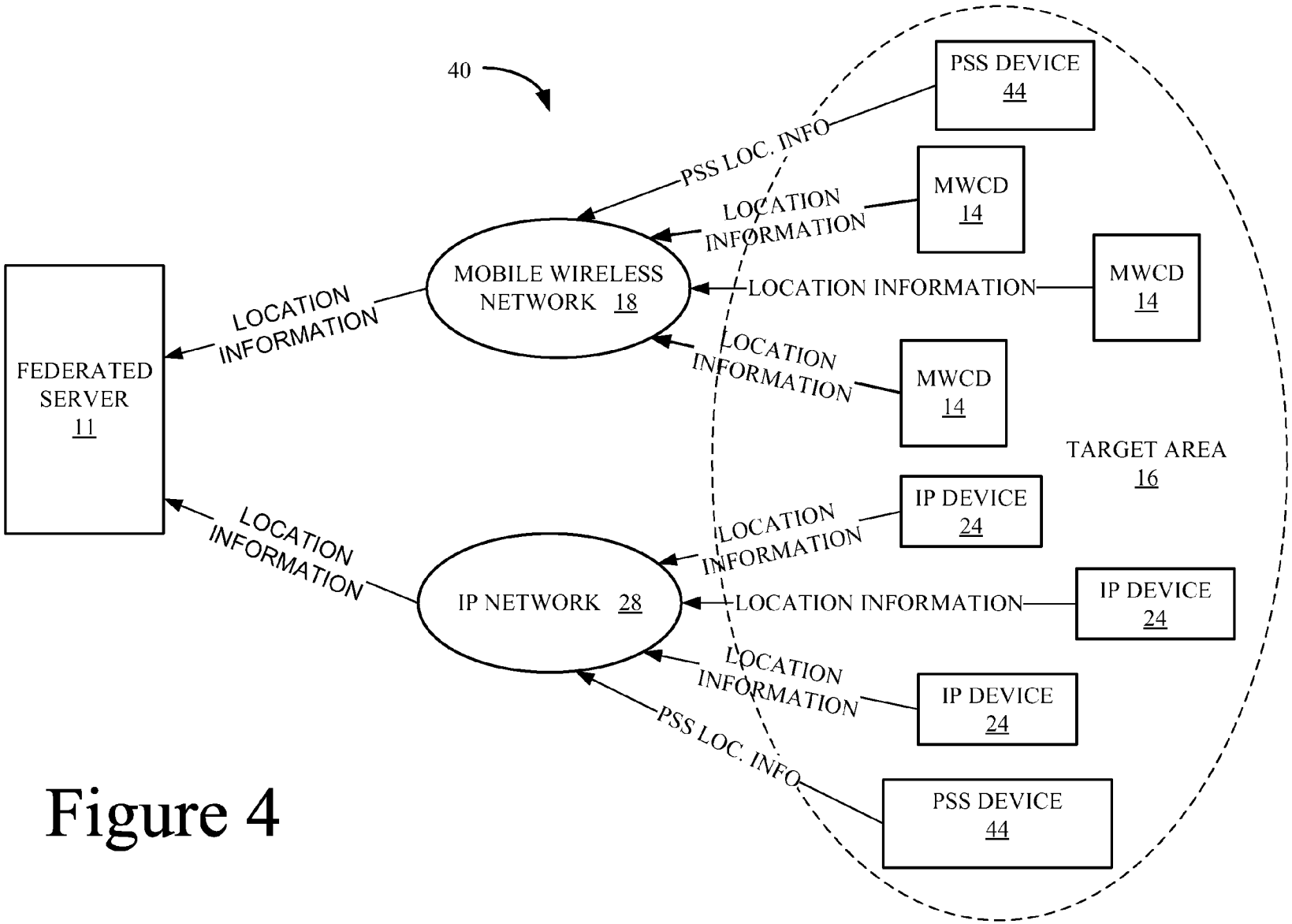

FIG. 4 is a block diagram illustrating a communication system 40, in accordance with exemplary embodiments. The communication system 40 includes the federated server 11, the MWCDs 14, the PSS device 44, and the IP devices 24. The PSS device 44 may be a communication and/or computing device such as, for example, a desktop computer, a notebook computer, a personal digital assistant, or a mobile phone. The PSS device 44, which may be located at the PSS 19, is configured to transmit location information corresponding to the PSS device 44 and/or the PSS 19 to the federated server 11. The transmitted location information may be, for example, in the form of longitude/latitude coordinates. The mobile wireless network 18 communicatively couples the federated server 11 and the MWCDs 14. The IP network 28 communicatively couples the federated server 11 and the IP devices 24.

Each of the devices 14, 24, and/or 44 may transmit corresponding location information to the federated server 11 responsive to, for example, a request from the federated server 11 for the location information and/or responsive to a location of the device 14, 24, or 44. For example, each of the devices 14, 24, and/or 44 may be configured to transmit associated location information when the device 14, 24, or 44 enters or leaves the target area 16. A device 14, 24, or 44 may, for example, have a software application that includes information regarding the scope of various target areas 16. Each device 14, 24, or 44 may compare location coordinates for such device 14, 24, or 44 with location coordinates of various target areas 16 to determine in which target area 16 the device 14, 24, or 44 is located. In this manner, a device 14, 24 or 44 is able to determine when the device 14, 24 or 44 enters or leaves a target area 16. Alternatively or additionally, each of the devices 14, 24, and/or 44 may provide the location information to the federated server 11 at predetermined times or time intervals.

The federated server 11 may use the location information received from the devices 14, 24, and/or 44 to identify devices located in one or more target areas, such as the target area 16. The federated server 11 may identify the devices 14, 24, and/or 44 located in a target area 16 by, for example, comparing the longitude and latitude coordinates of the devices 14, 24, and/or 44 with a range of coordinates corresponding to the target area 16. Information about the identified devices 14, 24, and/or 44 may then be used to enable the information server 17 to send location-specific information to the MWCDs 14 and/or the IP devices 24 located in the target area 16.

Each MWCD 14 and/or IP device 24 may also transmit user information for enabling customized location-specific information. The location-specific information may comprise text data, image data, and/or voice data. The user information provided by the MWCDs 14 and/or the IP devices 24 may include, for example, a user's physical condition, more specific location within the target area 16, whether the user is an emergency response person, product and/or service preferences, demographic information, and/or previous purchases.

Figure 5:
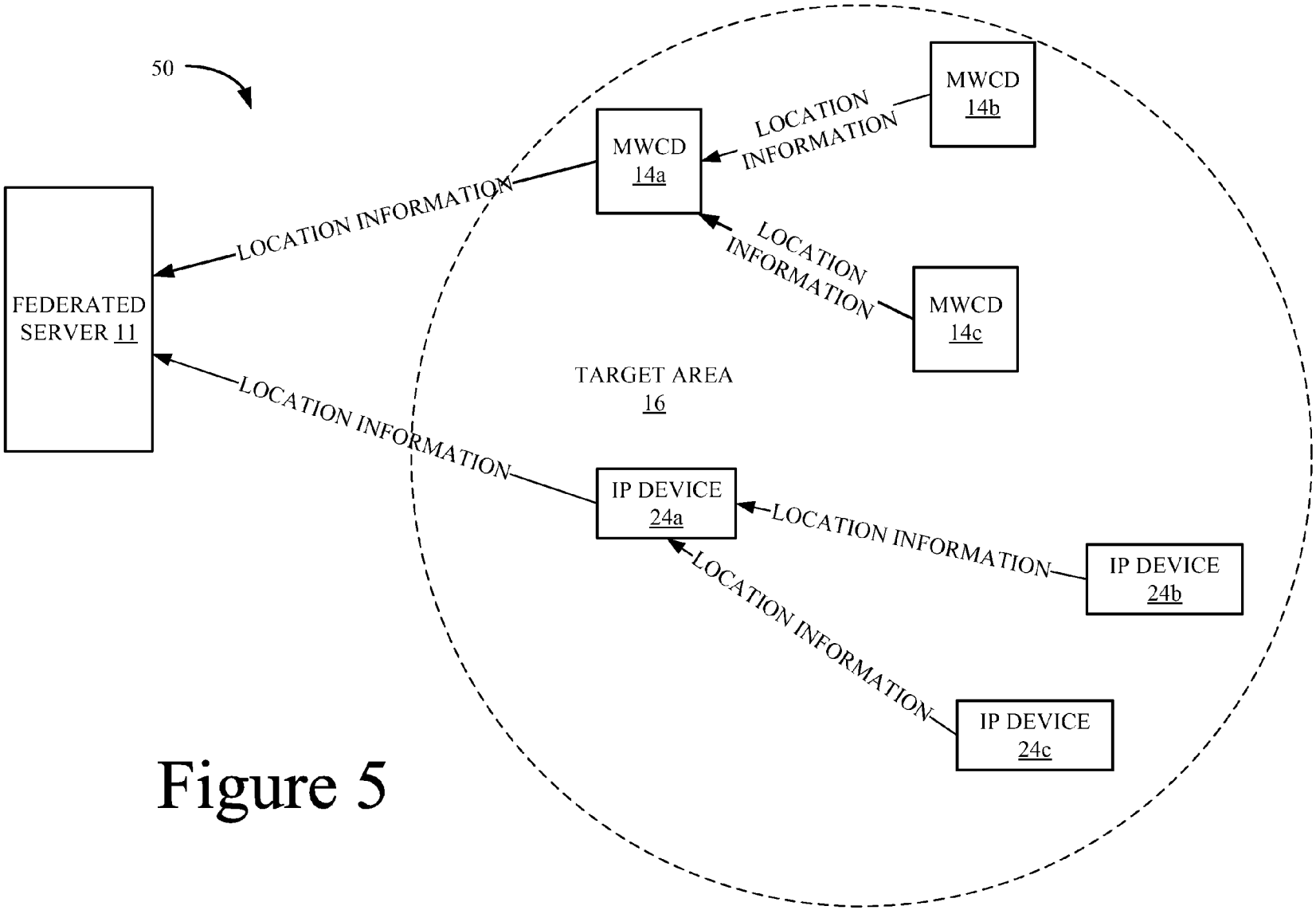

FIG. 5 is a block diagram illustrating a communication system 50, in accordance with exemplary embodiments. The communication system 50 includes the federated server 11, the MWCDs 14*a*-14*c*, and the IP devices 24*a*-24*c*. The mobile wireless network 18 may communicatively couple the federated server 11 and the MWCDs 14*a*-14*c*. The IP network 28 may communicatively couple the federated server 11 and the IP devices 24*a*-24*c*.

The MWCDs 14*b* and 14*c* may provide the MWCD 14*a* with respective user, location and/or contact information (e.g., phone numbers) for the MWCDs 14*b* and 14*c*. The MWCDs 14*b* and 14*c* may provide such information via a local area network (LAN) technology such as, for example, WiFi or via a mobile wireless communication technology such as, for example, GSM or UMTS. For example, each MWCD 14*a*-14*c* may be programmed to send out signals (e.g., via a wireless LAN) to determine if other MWCDs 14 are nearby and/or to inform other MWCDs 14 that such MWCD 14*a*, 14*b*, or 14*c* is nearby. Such signals may be sent out at predetermined times or time intervals and/or responsive to a request from the federated server 11.

If an MWCD 14*a* and 14*b* receive signals from each other, then each MWCD 14*a* and 14*b* may store information providing the identity and contact information of the other MWCD 14 and indicating that such other MWCD 14 is nearby. In this manner either or both MWCDs 14 that communicated with each other may send location information corresponding to the MWCDs 14 to the federated server 11. Since each MWCD 14 may be configured to provide location information to the federated server at a different time than other MWCDs 14, the federated server 11 may be able to receive current location information for a particular MWCD 14, say the MWCD 14*b*, even before such location information is provided by the MWCD 14*b*.

In the example shown in FIG. 5, the MWCD 14*a* transmits information corresponding to the MWCDs 14*a*-14*c* to the federated server 11 via the mobile wireless network 18. The MWCD 14*a* may provide the information to the federated server 11 responsive to, for example, a request from the federated server 11 for the information corresponding to the MWCDs 14*a*-14*c* and/or responsive to a location of the MWCD 14*a*. For example, the MWCD 14*a* may be configured to transmit information to the federated server 11 when a location of the MWCD 14*a* is within the target area 16. Alternatively or additionally, the MWCD 14*a* may provide the information to the federated server 11 at predetermined times or time intervals, or upon receiving the location information from the MWCDs 14*b* an 14*c*.

The IP devices 24*b* and 24*c* provide the IP device 24*a* with respective user, location and/or contact information (e.g., IP addresses) for the IP devices 24*b* and 24*c*. The IP devices 24*b* and 24*c* may provide such information using IP data transmitted via, for example, a local area network and/or the Internet. The IP device 24*a* transmits information corresponding to the IP devices 24*a*-24*c* to the federated server 11 via the IP network 28. The IP device 24*a* may provide the information to the federated server 11 responsive to, for example, a request from the federated server 11 for the information corresponding to the IP devices 24*a*-24*c* and/or responsive to a location of the IP device 24*a*. For example, the IP device 24*a* may be configured to transmit information to the federated server 11 when a location of the IP device 24*a* is within the target area 16. Alternatively or additionally, the IP device 24*a* may provide the information to the federated server 11 at predetermined times or time intervals, or upon receiving the location information from the IP devices 24*b* and 24*c*.

The federated server 11 may use information received from the MWCD 14*a* and/or the IP device 24*a* to identify devices located in one or more target areas, such as the target area 16. Information about the identified devices, such as the MWCDs 14*a*-14*c* and IP devices 24*a*-24*c*, may then be used to enable the information server 17 to send location-specific information to the MWCDs 14*a*-14*c* and/or the IP devices 24*a*-24*c* located in the target area 16.

Figure 6A:
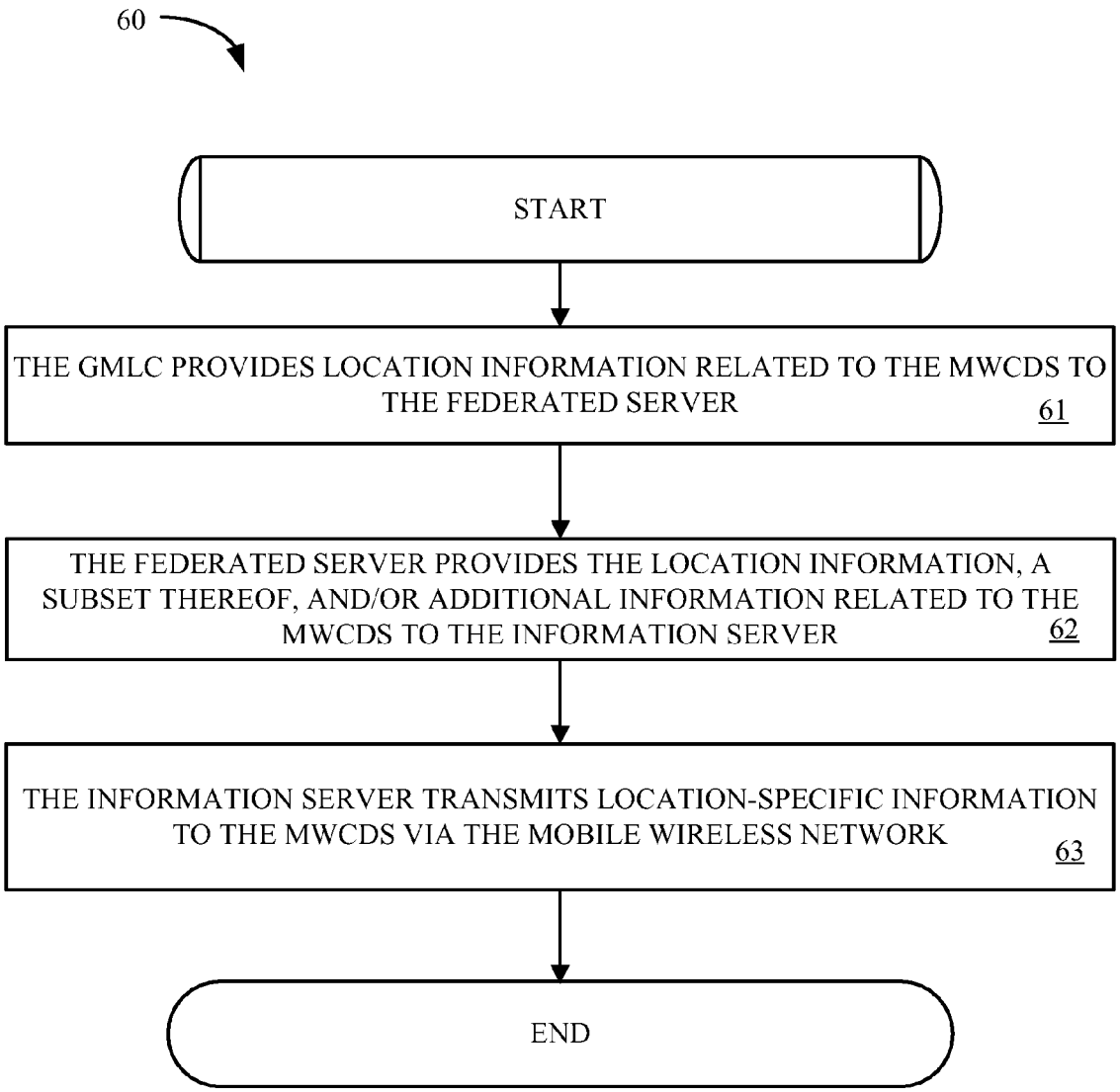
FIG. 6A is a flow chart illustrating a method for providing location-specific information, according to exemplary embodiments.

FIG. 6A is a flow chart illustrating a method 60 for providing location-specific information, according to exemplary embodiments. As indicated in box 61, the GMLC 12 provides location and/or contact information related to the MWCDs 14 to the federated server 11. The federated server 11 may receive location information related to the MWCDs 14 from a source other than the GMLC 12. For example, each MWCD 14 may provide the federated server 11 with location information corresponding to the MWCD 14 and/or other MWCDs 14.

The federated server 11 provides the location information, a subset thereof, and/or additional information related to the MWCDs 14 to the information server 17, as indicated in box 62. For example, instead of providing information on the exact location of the MWCDs 14, the federated server 11 may provide the information server 17 with information identifying the MWCDs 14 within the target area 16. The federated server 11 may also send contact information corresponding to the MWCDs 14 and information regarding users of the MWCDs to the information server 17.

The information server 17 transmits location-specific information to the MWCDs 14 via the mobile wireless network 18 based on the location and contact information provided by the federated server 11, as indicated in box 63. The location-specific information may comprise text data, image data, and/or voice data. As discussed above, the location-specific information may be customized based on information about respective users of the MWCDs 14. Advertising content provided by the information server 17 may be customized based on information about respective users of the MWCDs 14 and the IP devices 24, such as, for example, product preferences, service preferences, demographic information, and previous purchases. Emergency notification provided by the information server 17 may be customized based on, for example, a user's physical condition, more specific location within the target area 16, and whether the user is an emergency response person.

Figure 6B:
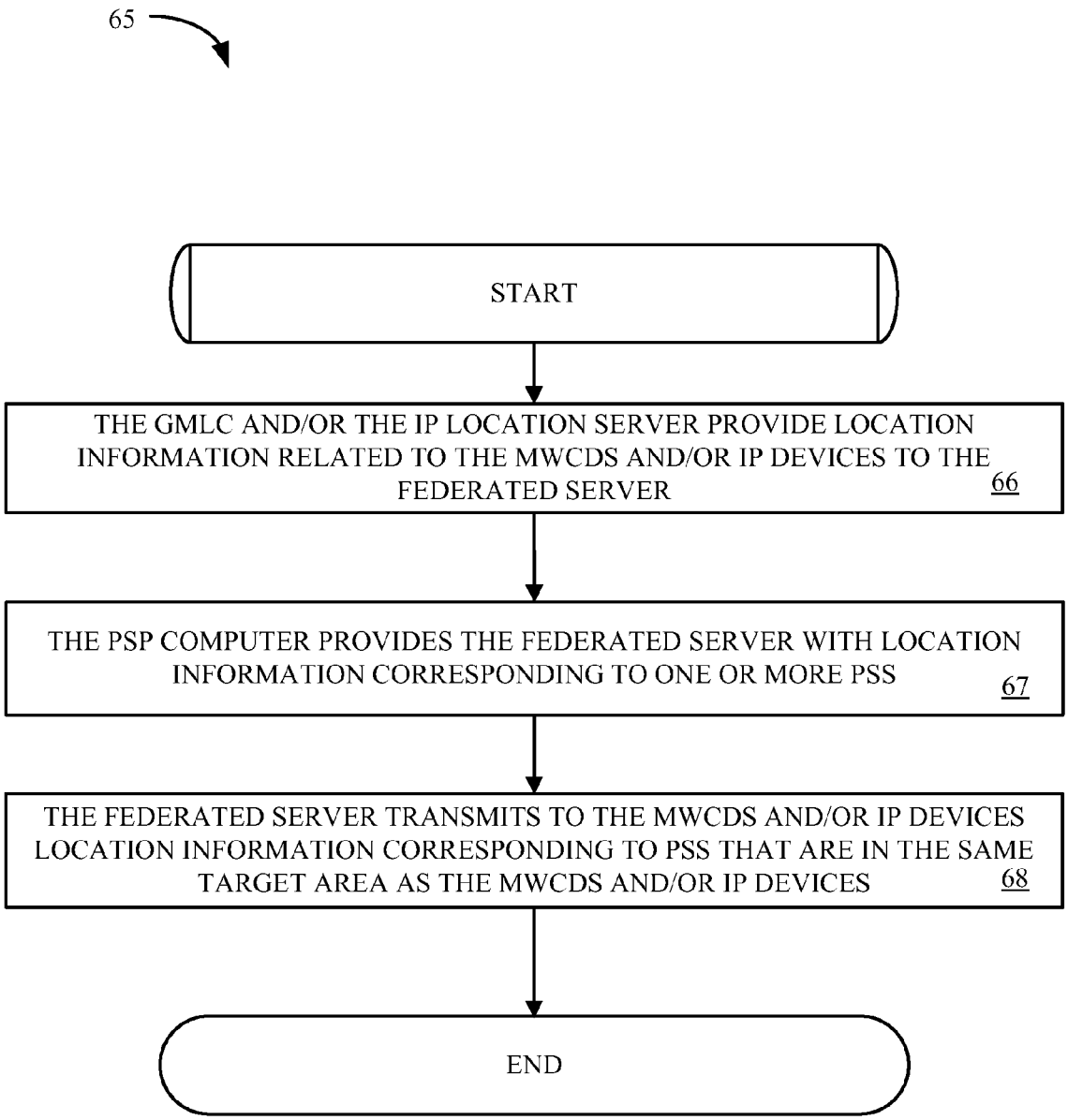
FIG. 6B is a flow chart illustrating a method for providing location information corresponding to a product/service source, according to exemplary embodiments.

FIG. 6B is a flow chart illustrating a method 65 for dynamically providing location information, according to exemplary embodiments. As indicated in box 66, the GMLC 12 and/or the IP location server 22 provide location information related to the MWCDs 14 and/or IP devices 24 to the federated server 11. The federated server 11 may receive location information related to the MWCDs 14 and/or IP devices 24 from alternative sources such as, for example, the MWCDs 14 and/or IP devices 24.

The information server 17 provides the federated server 11 with location information corresponding to one or more of the PSSs 19 associated with a target area, such as the target area 16, as indicated in box 67. For example, the information server 17 corresponding to a certain company may provide location information corresponding to one or more of the PSSs 19 located in respective target areas 16. Additionally or alternatively, the PSS device 44, the GMLC 12, and/or the IP location server 22 may provide the federated server 11 with location information corresponding to the PSS 19. As discussed above, the PSS device 44 may be, for example, a notebook or desktop computer located at the PSS 19.

The federated server 11 then transmits to the MWCDs 14 and/or IP devices 24 location information corresponding to the PSSs 19 that are in the same target area 16 as the MWCDs 14 and/or IP devices 24, as indicated in box 68. The PSS 19 location information may comprise text data, image data, and/or voice data. The PSS 19 location information may be customized or filtered based on information about respective users of the MWCDs 14 and/or IP devices 24, such as, for example, product preferences, service preferences, demographic information, and/or previous purchases.

Figure 7:
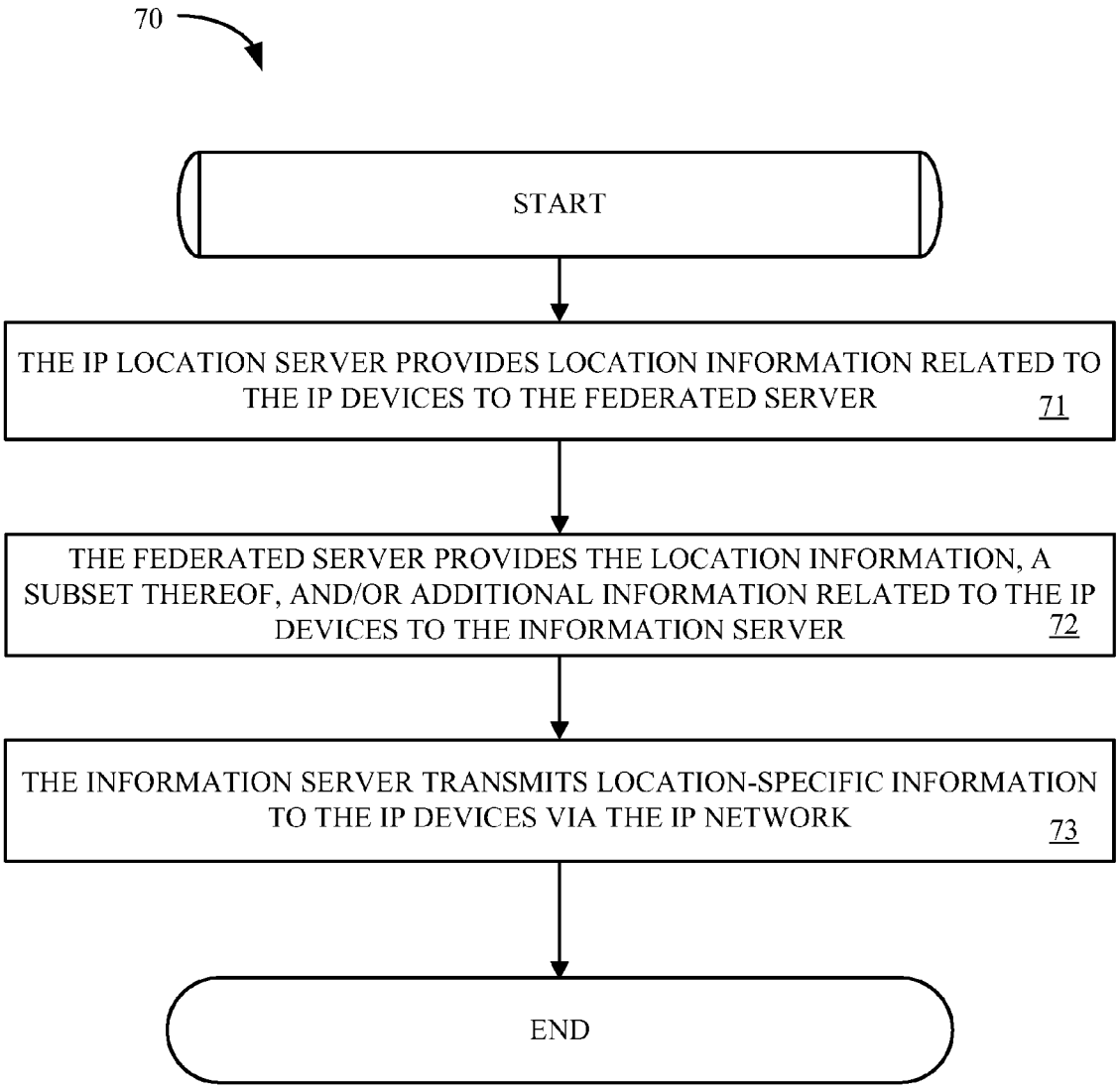
FIGS. 7 and 8 are flow charts illustrating respective methods for providing location-specific information, according to exemplary embodiments.

FIG. 7 is a flow chart illustrating a method 70 for providing location-specific information, according to exemplary embodiments. As indicated in box 71, the IP location server 22 provides location and/or contact information related to the IP devices 24 to the federated server 11. The federated server 11 may receive location information related to the IP devices 24 from a source other than the IP location server 22. For example, each IP device 24 may provide the federated server with location information corresponding to such IP device 24 and/or other IP devices 24.

The federated server 11 provides the location information, a subset thereof, contact information, information regarding users of the IP devices 24, and/or additional information related to the IP devices 24 to the information server 17, as indicated in box 72. For example, instead of providing information on the specific location of the IP devices 24, the federated server 11 may provide the information server 17 with information identifying the IP devices 24 within the target area 16. A determination as to whether an IP device 24 user is within the target area 16 may be based, for example, on the IP address being used by the IP device 24.

According to exemplary embodiments, the IP location server 22 may determine that an IP address being used by the IP device 24 corresponds to a certain longitude/latitude coordinates or a range of longitude/latitude coordinates, and may provide such coordinates to the federated server 11. The federated server 11 may then determine whether the IP device 24 is within the target area 16 based on whether the longitude/latitude coordinates of the IP device 24 fall within the longitude/latitude range of coordinates corresponding to the target area 16. If the federated server 11 is provided with a range of coordinates corresponding to the IP device 24, such as when a more exact location of the IP device 24 cannot be determined, then the federated server 11 may determine whether the IP device 24 is within the target area 16 based on whether the range of coordinates corresponding to the IP device 24 overlaps the range of coordinates corresponding to the target area 16. Where there are several target areas 16, the federated server 11 can use the longitude/latitude coordinates of devices 14 and/or 24 to determine in which target area 16 each device 14 or 24 is located.

The information server 17 transmits location-specific information to the IP devices 24 via the IP network 28, as indicated in box 73. The IP network 28 may comprise, for example, the Internet. As discussed above, the location-specific information may be customized based on information about respective users of the IP devices 24. The user information may include, for example, a user's physical condition, more specific location within the target area 16, whether the user is an emergency response person, product and/or service preferences, demographic information, and/or previous purchases.

Figure 8:
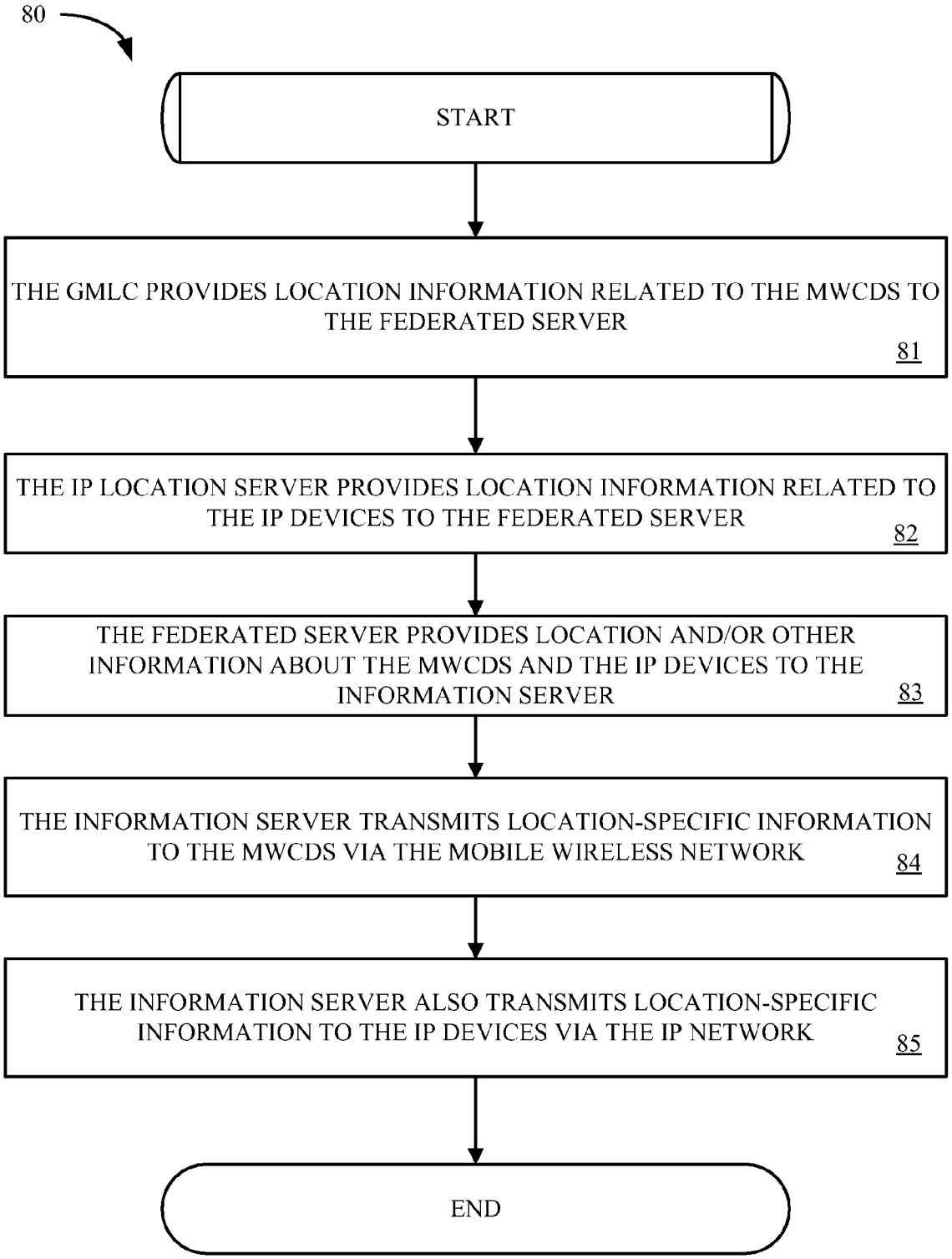

FIG. 8 is a flow chart illustrating a method 80 for providing location-specific information, according to exemplary embodiments. As indicated in box 81, the GMLC 12 provides location and/or contact information related to the MWCDs 14 to the federated server 11. The IP location server 22 provides location information related to the IP devices 24 to the federated server 11, as indicated in box 82. According to exemplary embodiments, the MWCDs 14 and the IP devices 24 are located in a particular target area, such as the target area 16. Alternatively, the MWCDs 14 and the IP devices 24 may be located in different target areas.

The federated server 11 provides location and/or other information about the MWCDs 14 and the IP devices 24 to the information server 17, as indicated in box 83. For example, the federated server 11 provides information identifying the IP devices 24 and the MWCDs 14 in the target area 16 and/or information that can be used to customize location-specific information transmitted by the information server 17.

The information server 17 transmits location-specific information to the MWCDs 14 via the mobile wireless network 18, as indicated in box 84. The information server 17 also transmits location-specific information to the IP devices 24 via the IP network 28, as indicated in box 85. As discussed above, the location-specific information may be customized based on information about respective users of the MWCDs 14 and the IP devices 24. Advertising content provided by the information server 17 may be customized based on information about respective users of the MWCDs 14 and the IP devices 24, such as, for example, product preferences, service preferences, demographic information, and previous purchases. Emergency notification provided by the information server 17 may be customized based on, for example, a user's physical condition, more specific location within the target area 16, and whether the user is an emergency response person.

Note that methods depicted in the exemplary flow charts described above may be modified to include fewer, additional, and/or different steps within the scope of this disclosure. Furthermore, steps depicted in the flow charts may be performed out of the order shown including substantially concurrently, in reverse order, or in a substantially different order.

Figure 9:
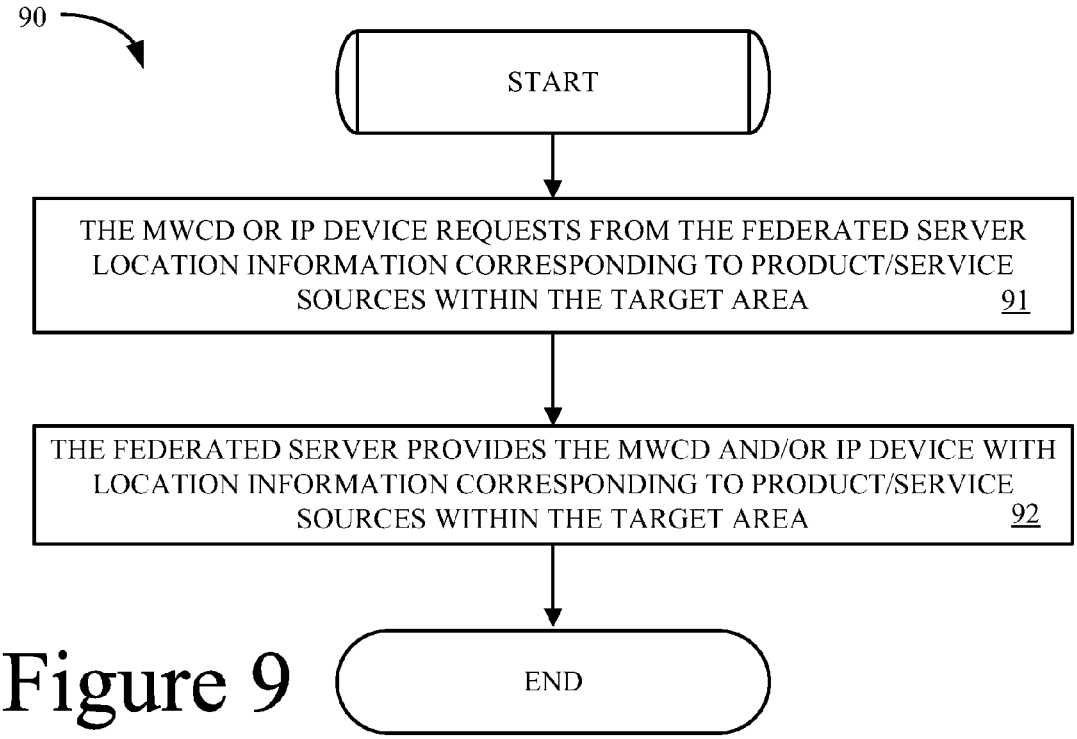
FIGS. 9-11 are flow charts illustrating respective methods for providing location information corresponding to product/service sources, according to exemplary embodiments.

FIG. 9 is a flow chart illustrating a method 90 for dynamically providing location information, according to exemplary embodiments. As indicated in box 91, the MWCD 14 or IP device 24 requests from the federated server 11 location information corresponding to the PSSs 19 within the target area 16. The location information may be requested by the device 14 or 24 responsive to, for example, user input, a current time, and/or a change in location of the device 14 or 24. Responsive to receiving the request from the device 14 or 24, the federated server 11 provides the MWCD 14 or IP device 24 with location information corresponding to the PSSs 19 within the target area 16, as indicated in box 92. The location information for each PSS 19 may have been provided to the federated server 11 by the PSS device 44 or by the information server 17. The location information may be provided to the device 14 or 24 in the form of longitude and latitude coordinates which are then translated by the device 14 or 24 into directions and/or a location on a map. Alternatively, the location information may be provided to the device 14 or 24 in the form of textual directions, voice directions, and/or map locations.

Figure 10:
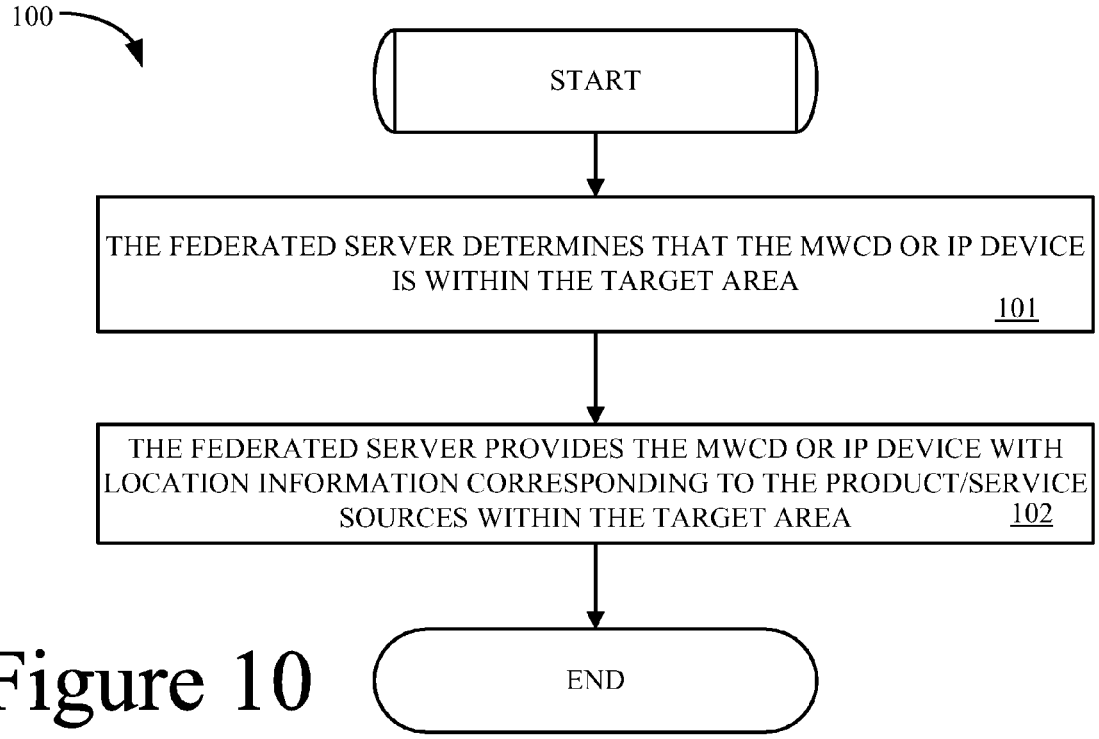

FIG. 10 is a flow chart illustrating a method 100 for dynamically providing location information, according to exemplary embodiments. As indicated in box 101, the federated server 11 determines that the MWCD 14 or IP device 24 is within the target area 16. The federated server 11 may determine that the device 14 or 24 is within the target area 16 by comparing longitude/latitude coordinates corresponding to the device 14 or 24 with a range of coordinates corresponding to the target area 16. The federated server 11 may have received the device location information from the device 14 or 24 or from another source such as the GMLC 12 or the IP location server 22. Responsive to determining that the MWCD 14 or IP device 24 is within the target area 16, the federated server 11 provides the MWCD 14 or IP device 24 via contact information associated with the MWCD 14 or IP device 24 with location information corresponding to the PSSs 19 within the target area 16, as indicated in box 102.

As discussed above, the location information for each PSS 19 may have been provided to the federated server 11 by the PSS device 44 or by the information server 17 based on the target area 16. The contact information associated with the MWCD 14 or IP device 24 may be provided to the federated server 11 by, for example, a back office server (BOS) or the information server 17. Users of MWCDs 14 and/or IP devices 24 may have provided respective contact information to the company or companies operating the federated server 11 and/or the information server 17 when such users subscribe to a service offered by such companies.

Figure 11:
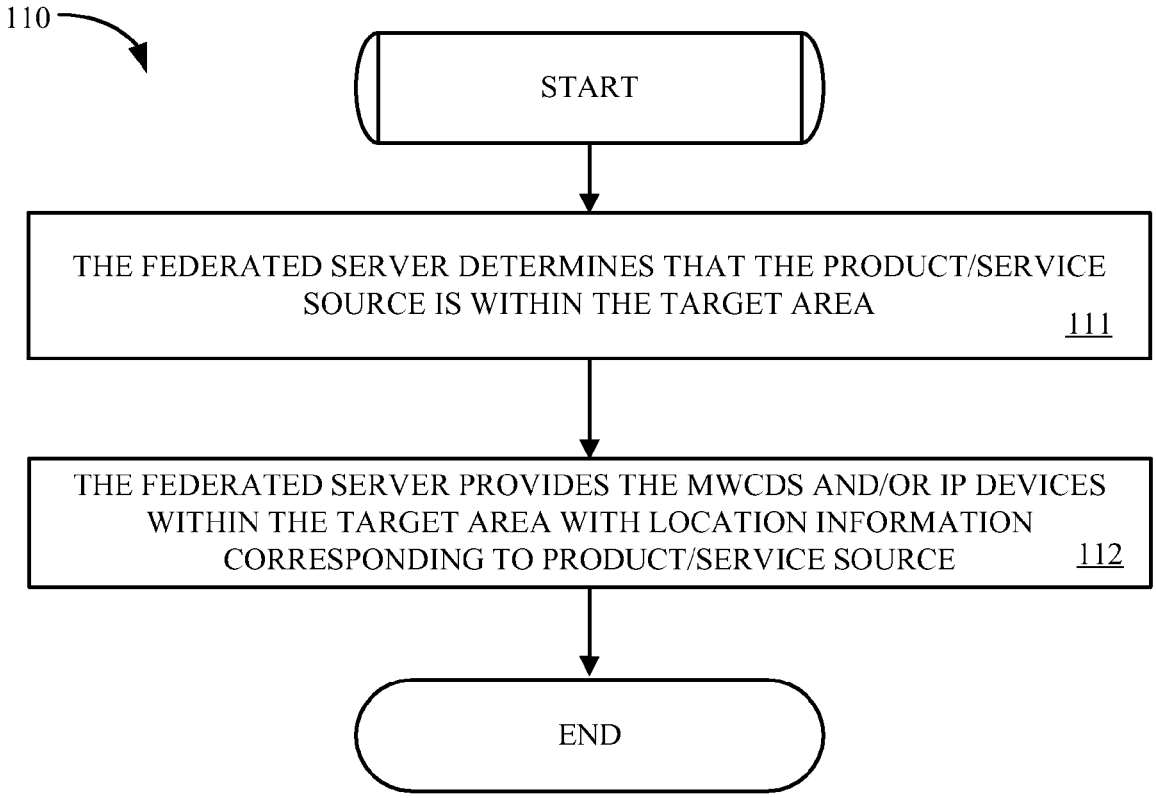

FIG. 11 is a flow chart illustrating a method 110 for dynamically providing location information, according to exemplary embodiments. As indicated in box 111, the federated server 11 determines that the PSS 19 is within the target area 16. The federated server 11 may determine that the PSS 19 is within a target area 16 by comparing longitude/latitude coordinates corresponding to the PSS 19 with a range of coordinates corresponding to the target area 16. Note that the PSS 19 may be a mobile product/service source such as, for example, an ice-cream truck. Therefore, the federated server 11 may determine at certain time intervals whether PSSs, such as the PSS 19, have entered into or departed from a target area 16.

The federated server 11 may have received the PSS 19 location information from the PSS device 44 or from another source such as the information server 17. As discussed above, the federated server 11 may provide the information server 17 with information identifying the scope of the target area 16 so that the information server 17 can identify the PSSs 19 located in the target area 16. Alternatively, the information server 17 provides the federated server 11 with location information corresponding to various PSSs 19 located in various target areas 16 and the federated server 11 then determines which target area 16 corresponds to each PSS 19.

Responsive to determining that the PSS 19 is within the target area 16, the federated server 11 provides the MWCD 14 or IP device 24 within the target area 16 with location information corresponding to the PSS 19, as indicated in box 112. As discussed above, the federated server 11 may determine that the device 14 or 24 is within a target area 16 by comparing longitude/latitude coordinates corresponding to the device 14 or 24 with a range of coordinates corresponding to the target area 16.

Note that methods depicted in the exemplary flow charts described above may be modified to include fewer, additional, and/or different steps within the scope of this disclosure. Furthermore, steps depicted in the flow charts may be performed out of the order shown including substantially concurrently, in reverse order, or in a substantially different order.

Figure 12:
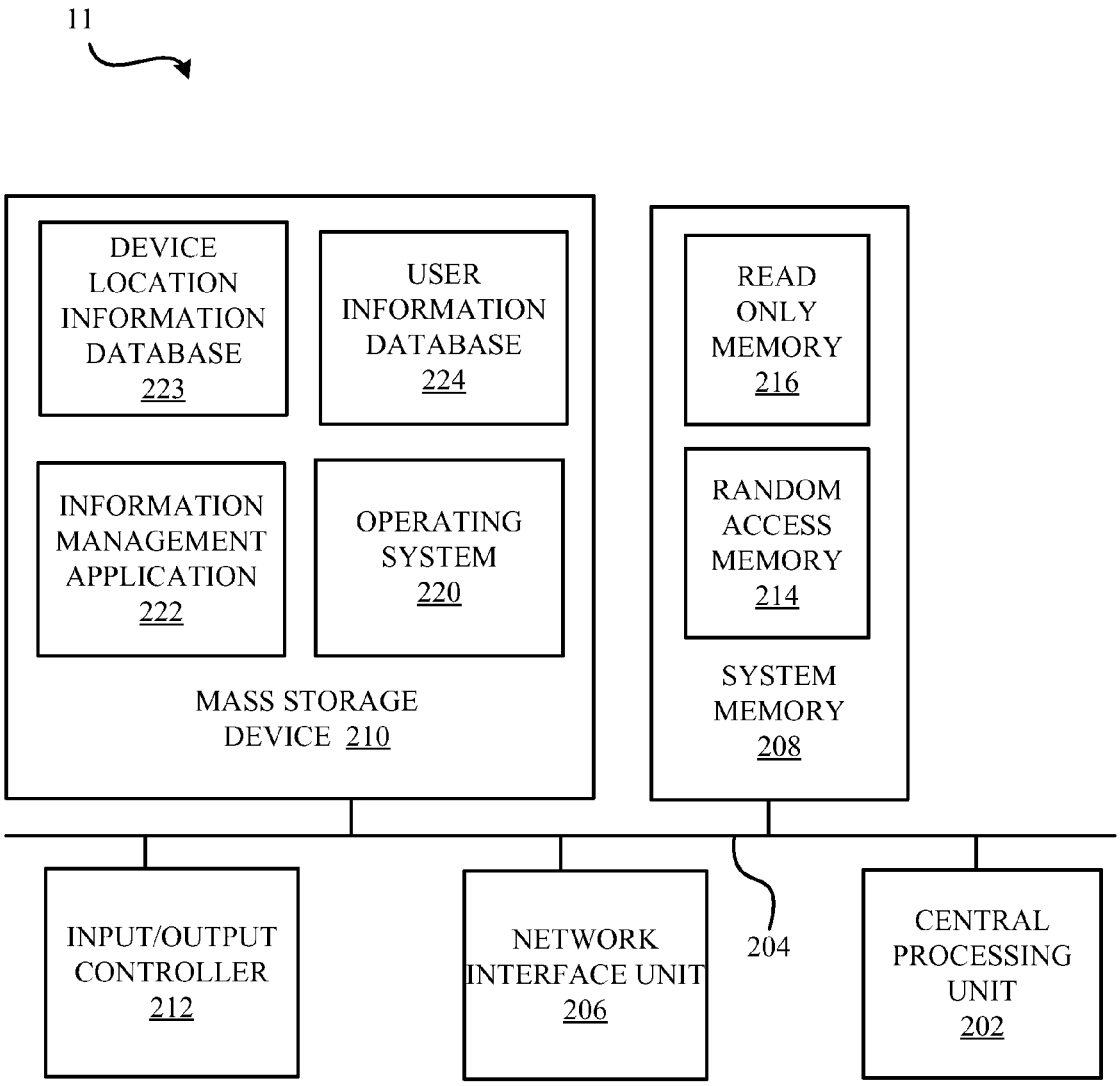
FIG. 12 is a block diagram illustrating a federated server, in accordance with exemplary embodiments.

FIG. 12 is a block diagram illustrating the federated server 11, in accordance with exemplary embodiments. The federated server 11 includes a central processing unit (CPU) 202, a system memory 208, including a random access memory (RAM) 214 and a read-only memory (ROM) 216, and a system bus 204 that couples the memory 208 to the CPU 202. A basic input/output system containing the basic routines that help to transfer information between elements within the federated server 11, such as during startup, is stored in the ROM 216. The federated server 11 further includes a mass storage device 210 for storing an operating system 220 and other program modules, which will be described in greater detail below.

The mass storage device 210 is connected to the CPU 202 through a mass storage controller (not shown) connected to the bus 204. The mass storage device 210 and its associated computer-readable media provide non-volatile storage for the federated server 11. Although the description of computer-readable media contained herein refers to a mass storage device, such as a hard disk or CD-ROM drive, it should be appreciated by those skilled in the art that computer-readable media can be any available media that can be accessed by the federated server 11.

By way of example, and not limitation, computer-readable media may include volatile and non-volatile, removable and non-removable media implemented in any method or technology for storage of information such as computer-readable instructions, data structures, program modules or other data. For example, computer-readable media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the federated server 11.

The federated server 11 may connect to a network through a network interface unit 206 connected to the bus 204. It should be appreciated that the network interface unit 206 may also be utilized to connect to other types of networks and remote computer systems. The federated server 11 may also include an input/output controller 212 for receiving and processing input from a number of other devices, including a keyboard, mouse, or electronic stylus (not shown in FIG. 12). Similarly, the input/output controller 212 may provide output to a display screen, a printer, or other type of output device (also not shown in FIG. 12).

As mentioned briefly above, a number of program modules and data files may be stored in the mass storage device 210 and RAM 214 of the federated server 11, including the operating system 220 suitable for controlling the operation of the federated server 11. The mass storage device 210 and RAM 214 may also store one or more program modules. In particular, the mass storage device 210 and the RAM 214 may store an information management application 222 configured to receive and manage information corresponding to the MWCDs 14 and/or IP devices 24. Other program modules may also be stored in the mass storage device 210 and utilized by the federated server 11.

According to exemplary embodiments, the information management application 222 receives location, contact, and/or user information corresponding to the MWCDs 14 and/or IP devices 24 from the IP location server 22 and/or the GMLC 12 and stores the received information in a device location information database 223. Note that respective location, contact, and/or user information may alternatively or additionally be received by the information management application 222 from the MWCDs 14 and/or IP devices 24. Although the device location information database 223 is described herein as being associated with the federated server 11, the database 223 may be remotely located from the federated server 11 such that the federated server 11 accesses the database 223 via a network, such as the IP network 28.

The information management application 222 may process the received information to determine whether the MWCDs 14 and/or IP devices 24 are within a particular area, such as the target area 16. For example, the information management application 222 may receive location information corresponding to the MWCDs 14 and/or IP devices 24 having various random locations. The information management application 222 may then process the location information received to identify a subset of the MWCDs 14 and/or IP devices 24 located in a particular target area, such as the target area 16. The information management application 222 may determine whether the device 14 or 24 is within the target area 16 based on whether the longitude/latitude coordinates of the device 14 or 24 fall within the longitude/latitude range of coordinates corresponding to the target area 16. If the information management application 222 is provided with a range of coordinates corresponding to the device 14 or 24, such as when a more exact location of the device 14 or 24 cannot be determined, then the information management application 222 may determine whether the device 14 or 24 is within the target area 16 based on whether the range of coordinates corresponding to the device 14 or 24 overlaps the range of coordinates corresponding to the target area 16. Where there are several target areas 16, the information management application 222 can use the longitude/latitude coordinates of devices 14 and/or 24 to determine in which target area 16 each device 14 or 24 is located.

The information management application 222 may then provide location information, user information, and contact information, such as phone number or Internet address (e.g., e-mail address), corresponding to the subset of the MWCDs 14 and/or IP devices 24 to the information server 17.

The information management application 222 may also be configured to determine if location information corresponding to a device is still valid. The determination may be based on a time since the location information has been received, on a type of device to which the location information corresponds, and/or on a location history of the device. Location information corresponding to a particular MWCD 14 or IP device 24 and stored in the location information database 223 may be updated by the information management application 222 when more recent location information corresponding to the MWCD 14 or IP device 24 is received by the information management application 222.

The information management application 222 may also provide the information server 17 with information regarding the users of the MWCDs 14 and/or IP devices 24. The user information may have been provided by device 14/24 users to the entity or entities owning or operating the federated server 11 and/or the information server 17 at a time, for example, that such users subscribed to one or more services provided by such entity or entities. Information regarding the users of the MWCDs 14 and/or IP devices 24 may be stored, for example, in a user information database 224. Although the user information database 224 is described herein as being associated with the federated server 11, the database 224 may be remotely located from the federated server 11 such that the federated server 11 accesses the database 224 via a network, such as the IP network 28. Note that the location information as well as the information regarding the users of the MWCDs 14 and/or IP devices 24 may alternatively be stored in a single database.

The information management application 222 may receive location information corresponding to the PSS 19 from the PSS device 44 and/or from the information server 17. The information management application 222 transmits the PSS 19 location information to the MWCDs 14 and/or IP devices 24 located within the same target area 16 as the PSS 19 via contact information associated with the MWCDs 14 and/or IP devices 24. The contact information may have been provided to the information management application 222 by a back office server (BOS). The PSS 19 location information may comprise text data, image data, and/or voice data. For example, the PSS 19 location information may include longitude/latitude coordinates, a map that shows PSS 19 location (s), text directions to the PSS 19, and/or voice directions to the PSS 19. As discussed above, the PSS 19 location information may be customized or filtered based on information about respective users of the MWCDs 14, such as, for example, product preferences, service preferences, demographic information, and/or previous purchases.

Figure 13:
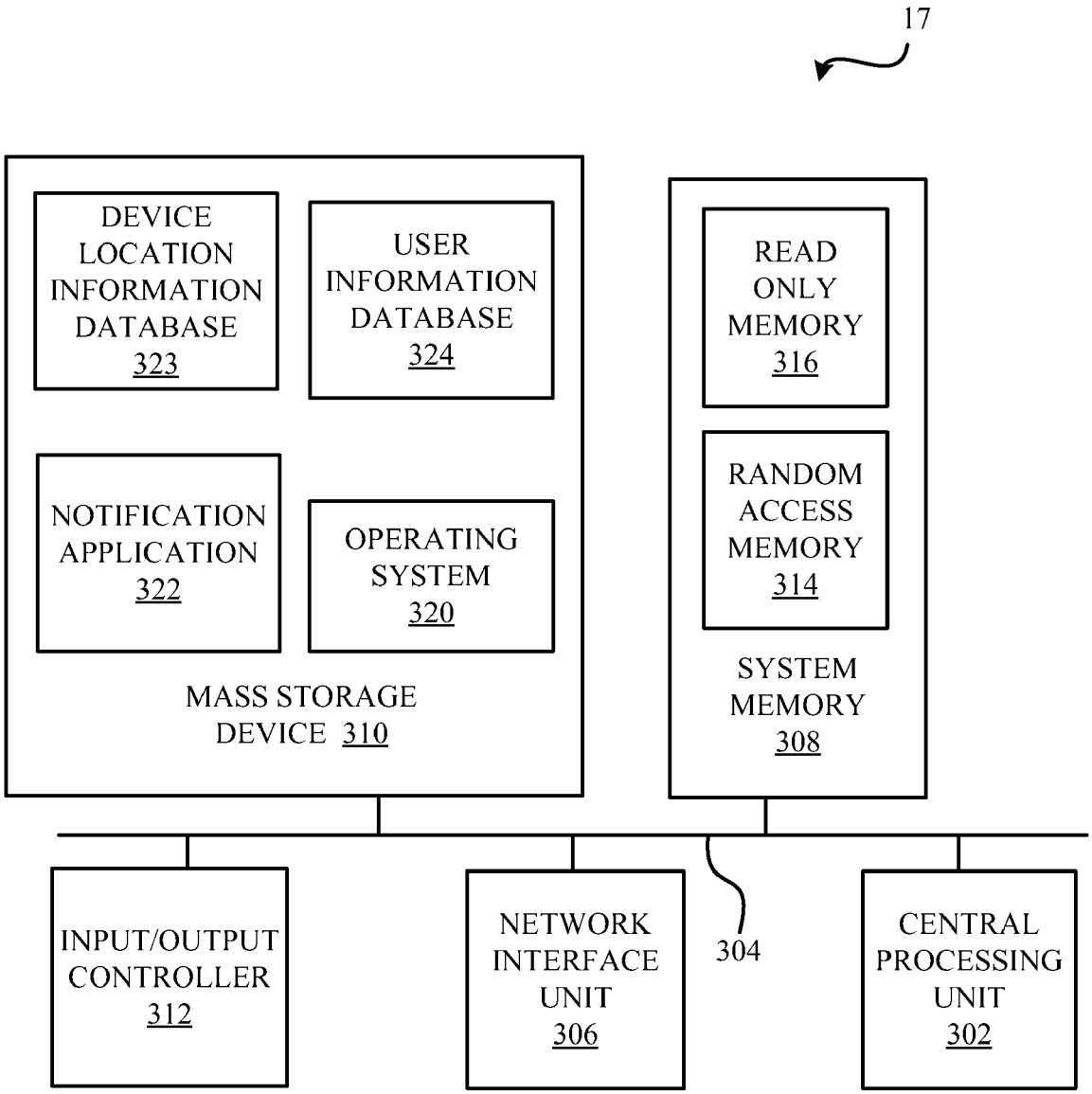
FIG. 13 is a block diagram illustrating an information server, in accordance with exemplary embodiments.

FIG. 13 is a block diagram illustrating the information server 17, in accordance with exemplary embodiments. The information server 17 includes a central processing unit (CPU) 302, a system memory 308, including a random access memory (RAM) 314 and a read-only memory (ROM) 316, and a system bus 304 that couples the memory 308 to the CPU 302. A basic input/output system containing the basic routines that help to transfer information between elements within the information server 17, such as during startup, is stored in the ROM 316. The information server 17 further includes a mass storage device 310 for storing an operating system 320 and other program modules, which will be described in greater detail below.

The mass storage device 310 is connected to the CPU 302 through a mass storage controller (not shown) connected to the bus 304. The mass storage device 310 and its associated computer-readable media provide non-volatile storage for the information server 17. Although the description of computer-readable media contained herein refers to a mass storage device, such as a hard disk or CD-ROM drive, it should be appreciated by those skilled in the art that computer-readable media can be any available media that can be accessed by the information server 17.

By way of example, and not limitation, computer-readable media may include volatile and non-volatile, removable and non-removable media implemented in any method or technology for storage of information such as computer-readable instructions, data structures, program modules or other data. For example, computer-readable media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the information server 17.

The information server 17 may connect to a network through a network interface unit 306 connected to the bus 304. It should be appreciated that the network interface unit 306 may also be utilized to connect to other types of networks and remote computer systems. The information server 17 may also include an input/output controller 312 for receiving and processing input from a number of other devices, including a keyboard, mouse, or electronic stylus (not shown in FIG. 13). Similarly, the input/output controller 312 may provide output to a display screen, a printer, or other type of output device (also not shown in FIG. 13).

As mentioned briefly above, a number of program modules and data files may be stored in the mass storage device 310 and RAM 314 of the information server 17, including the operating system 320 suitable for controlling the operation of the information server 17. The mass storage device 310 and RAM 314 may also store one or more program modules. In particular, the mass storage device 310 and the RAM 314 may store a notification application 322 configured to provide location-specific information to the MWCDs 14 and/or IP devices 24 located in the target areas 16. The location-specific information, which may include image, text, and/or voice data, may be provided via, for example, e-mail, SMS, and/or voice messages. Other program modules may also be stored in the mass storage device 310 and utilized by the information server 17.

According to exemplary embodiments, the notification application 322 receives location information corresponding to the MWCDs 14 and/or IP devices 24 from the federated server 11 and stores the location information in a device location information database 323. The location information stored in the device location information database 323 identifies, for example, the MWCDs 14 and/or IP devices 24 located in the particular target area 16 and/or respective contact information such as phone number or Internet address (e.g., e-mail address) corresponding to the MWCDs 14 and/or IP devices 24. The target area 16 may be determined, for example, by the entity or entities owning and/or operating the information server 17 and/or the federated server 11. Where the target area 16 is determined by the entity owning and/or operating the federated server 11, information identifying the target area 16 may be provided by the federated server 11 to the notification application 322. Where the notification application 322 provides location-specific information to devices 14/24 located in several respective target areas 16, then the notification application 322 may have location-specific information that is specifically targeted to each of the target areas 16. For example, devices 14 and/or 24 located in a first target area 16 corresponding to a certain shopping mall may receive from the notification application 322 location-specific information corresponding to products and/or services provided via stores located at such shopping mall. On the other hand, devices 14 and/or 24 located in a second target area 16 corresponding to, for example, an airport may receive from the notification application 322 location-specific information corresponding to airlines operating at such airport.

The notification application 322 may also receive user information corresponding to the users of the MWCDs 14 and/or IP devices 24 from the federated server 11. Information corresponding to the users of the MWCDs 14 and/or IP devices 24 may be stored, for example, in a user information database 324. Although the user information database 324 is described herein as being associated with the information server 17, the database may be remotely located from the server such that the server accesses the database via a network, such as the IP network 28. Information stored in the user information database 324 may identify, for example, a user's physical condition, more specific location within the target area 16, whether the user is an emergency response person, product and/or service preferences, demographic information, and/or previous purchases.

Advertising content provided by the notification application 322 may be customized based on information about respective users of the MWCDs 14 and the IP devices 24, such as, for example, product preferences, service preferences, demographic information, and previous purchases. Emergency notification provided by the notification application 322 may be customized based on, for example, a user's physical condition, more specific location within the target area 16, and whether the user is an emergency response person.

The notification application 322 may also be configured to provide PSS 19 location information to the federated server 11. The PSS 19 location information provided to the federates server 11 may include, for example, longitude/latitude coordinates corresponding to the PSS 19. Note that the PSS 19 location information may have been entered into the information server 17 by, for example, an employee of the product and/or service provider operating the information server 17. The federated server 11 may provide the notification application 322 with information identifying the scope of the target area 16 so that the notification application 322 can identify the PSSs 19 located in the target area 16. After the notification application 322 identifies PSSs 19 located in the target area 16, the notification application 322 provides the federated server 11 with location information corresponding to such PSSs 19. Alternatively, the notification application 322 provides the federated server 11 with location information corresponding to various PSSs 19 located in various target areas and the federated server 11 then determines which target area 16 corresponds to each PSS 19. The notification application 322 may provide the PSS 19 location information to the federated server 11 responsive to, for example, a request by the federated server 11 for such information.

Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims. Various modifications and changes may be made to the subject matter described herein without following the example embodiments and applications illustrated and described, and without departing from the true spirit and scope of the embodiments, which is set forth in the following claims.

What is claimed is:

1. A method for providing location-specific information, comprising:

receiving device information corresponding to a first plurality of communication devices including at least a first communication device and a second communication device, the device information comprising location information corresponding to each of the first plurality of communication devices and comprising an occupation of a user of the first communication device, and the location information corresponding to the second communication device received from the first communication device;

based on the location information corresponding to the first plurality of communication devices, determining that the first communication device is located within a first remote area affected by an emergency during a first time period;

determining, based on the device information received, whether the occupation of the user of the first communication device is relevant to the emergency; and if the occupation of the user of the first communication device is relevant to the emergency, then transmitting first location-specific information during the first time period to the first communication device via contact information associated with the first communication device, wherein the first location-specific information is responsive to the first remote area and wherein the first location-specific information comprises customized information about how to help with the emergency based on the occupation of the user.

2. The method of claim 1, wherein the first location-specific information comprises advertising content.

3. The method of claim 1, wherein the first location-specific information comprises an emergency notification.

4. The method of claim 1, wherein the first location-specific information comprises purchase opportunity location information.

5. The method of claim 1, wherein the first location-specific information is further responsive to the first time period and to at least one user parameter corresponding to the user of the first communication device, the at least one user parameter comprising at least one of a user purchase, a user characteristic, a user preference, and a user medical condition.

6. The method of claim 1, further comprising:

based on the location information corresponding to the first plurality of communication devices, determining that the second communication device among the first plurality of communication devices is located within the first remote area during the first time period; and transmitting second location-specific information to the second communication device during the first time period, wherein the second location-specific information transmitted to the second communication device is responsive to the first remote area and is different from the first location-specific information transmitted to the first communication device.

7. The method of claim 1, further comprising:

based on the location information corresponding to the first plurality of communication devices, determining that a second plurality of communication devices is located within a second remote area, the second plurality of devices being a subset of the first plurality of devices; and transmitting second location-specific information to the second plurality of devices, wherein the second location-specific information transmitted to the second plurality of devices is responsive to the second remote area.

8. The method of claim 1, further comprising:

determining that the first communication device is located within a second remote area during a second time period; and transmitting second location-specific information to the first communication device during the second time period, wherein the second location-specific information transmitted to the first device during the second time period is responsive to the second remote area.

9. The method of claim 1, wherein each of the first plurality of communication devices is one of a mobile wireless communication device, a desktop computer, a notebook computer, and a personal digital assistant, wherein the device information corresponding to the first plurality of communication devices includes information identifying at least one of an e-mail address and a telephone number corresponding to each of the first plurality of communication devices, and wherein the first location-specific information is transmitted via at least one of an e-mail message and a short message service message.

10. A system for providing location-specific information, comprising:

a processor; and memory having program instructions stored thereon, the program instructions being executable by the processor and configured to enable the system to:

receive device information corresponding to a first plurality of communication devices including at least a first communication device and a second communication device, the device information comprising location information corresponding to each of the first plurality of communication devices and comprising an occupation of a user of the first communication device, and the location information corresponding to the second communication device received from the first communication device, determine, based on the location information corresponding to the first plurality of communication devices, that the first communication device is located within a first remote area affected by an emergency during a first time period, determine, based on the device information received, whether the occupation of the user of the first communication device is relevant to the emergency; and if the occupation of the user of the first communication device is relevant to the emergency, then transmit the location-specific information during the first time period to the first communication device via contact information associated with the first communication device, wherein the location-specific information is responsive to the first remote area and wherein the location-specific information comprises customized information about how to help with the emergency based on the occupation of the user.

11. The system of claim 10, wherein the location-specific information comprises advertising content.

12. The system of claim 10, wherein the location-specific information comprises an emergency notification.

13. The system of claim 10, wherein the location-specific information comprises purchase opportunity location information.

14. The system of claim 10, wherein the location-specific information is further responsive to the first time period and to at least one user parameter corresponding to the user of the first communication device, the at least one user parameter comprising at least one of a user purchase, a user characteristic, a user preference, and a user medical condition.

15. The system of claim 10, wherein each of the first plurality of communication devices is one of a mobile wireless communication device, a desktop computer, a notebook computer, and a personal digital assistant, wherein the device information corresponding to the first plurality of communication devices includes information identifying at least one of an e-mail address and a telephone number corresponding to each of the first plurality of communication devices, and wherein the location-specific information is transmitted via at least one of an e-mail message and a short message service message.

16. A non-transitory computer-readable storage medium for dynamically providing location-specific information, comprising:

computer readable instructions configured to enable a computer to:

receive device information corresponding to a first plurality of communication devices including at least a first communication device and a second communication device, the device information comprising location information corresponding to each of the first plurality of communication devices and comprising an occupation of a user of the first communication device, and the location information corresponding to the second communication device received from the first communication device;

determine, based on the location information corresponding to the first plurality of communication devices, that the first communication device is located within a first remote area affected by an emergency during a first time period;

determine, based on the device information received, whether the occupation of the user of the first communication device is relevant to the emergency; and if the occupation of the user of the first communication device is relevant to the emergency, then transmit the location-specific information during the first time period to the first communication device via contact information associated with the first communication device, wherein the location-specific information is responsive to the first remote area and wherein the location-specific information comprises customized information about how to help with the emergency based on the occupation of the user.

17. The non-transitory computer-readable storage medium of claim 16, wherein the location-specific information comprises advertising content.

18. The non-transitory computer-readable storage medium of claim 16, wherein the location-specific information comprises an emergency notification.

19. The non-transitory computer-readable storage medium of claim 16, wherein the location-specific information comprises purchase opportunity location information.

20. The non-transitory computer-readable storage medium of claim 16, wherein the location-specific information is further responsive to the first time period and to at least one user parameter corresponding to the user of the first communication device, the at least one user parameter comprising at least one of a user purchase, a user characteristic, a user preference, and a user medical condition.

21. The non-transitory computer-readable storage medium of claim 16, wherein each of the first plurality of communication devices is one of a mobile wireless communication device, a desktop computer, a notebook computer, and a personal digital assistant, wherein the device information corresponding to the first plurality of communication devices includes information identifying at least one of an e-mail address and a telephone number corresponding to each of the first plurality of communication devices, and wherein the location-specific information is transmitted via at least one of an e-mail message and a short message service message.

22. A method for enabling dynamic location-specific emergency notification, comprising:

receiving device information corresponding to a plurality of communication devices, wherein the device information comprises location information corresponding to each of the plurality of communication devices and comprises an occupation of a user of a communication device among the plurality of communication devices;

based on the location information corresponding to the plurality of communication devices, determining that the communication device among the plurality of communication devices is located within a remote area affected by an emergency during a time period;

determining whether the occupation of the user of the communication device is relevant to the emergency; and if the occupation of the user of the communication device is relevant to the emergency, then transmitting an emergency notification associated with the emergency during the time period to the communication device via contact information associated with the communication device, the emergency notification including information about the emergency associated with the remote area and customized information about how to help with the emergency based on the occupation of the user.

* * * * *